US007684917B2

(12) United States Patent
Furuno et al.

(10) Patent No.: US 7,684,917 B2
(45) Date of Patent: Mar. 23, 2010

(54) DIAGNOSTIC INFORMATION PROVIDING APPARATUS FOR CONSTRUCTION MACHINE AND DIAGNOSTIC INFORMATION DISPLAY SYSTEM FOR CONSTRUCTION MACHINE

(75) Inventors: Yoshinori Furuno, Tsuchiura (JP); Munenobu Seo, Tsukuba (JP); Kenichi Sagiya, Chikusei (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 247 days.

(21) Appl. No.: 11/571,482

(22) PCT Filed: Oct. 27, 2005

(86) PCT No.: PCT/JP2005/019767

§ 371 (c)(1),
(2), (4) Date: Dec. 29, 2006

(87) PCT Pub. No.: WO2006/054434

PCT Pub. Date: May 26, 2006

(65) Prior Publication Data

US 2007/0213855 A1 Sep. 13, 2007

(51) Int. Cl.
*G05B 15/00* (2006.01)
*G06F 19/00* (2006.01)

(52) U.S. Cl. ..... 701/50; 700/83

(58) Field of Classification Search ..... 701/50; 700/83

See application file for complete search history.

(56) References Cited

U.S. PATENT DOCUMENTS 6,349,252 B1 * 2/2002 Imanishi et al. ..... 701/50
2003/0146845 A1 8/2003 Imanishi et al. ..... 340/679

FOREIGN PATENT DOCUMENTS

JP 7-119183 5/1995
JP 2002-180502 6/2002
JP 2002-323013 11/2002
JP 2004-075206 3/2004

* cited by examiner

*Primary Examiner*—Ryan A Jarrett
(74) *Attorney, Agent, or Firm*—Mattingly & Malur, P.C.

(57) ABSTRACT

A diagnostic information display system for a construction machine includes a sensor for detecting status variables related to an operating state of a hydraulic excavator or ambient environment, and a controller which stores combinations between a plurality of snapshot items and one or more status variables related to each of the snapshot items in advance, acquires or extracts status variable data, which is regarded as being related based on the stored combinations, from corresponding detected signals of the sensor 40, etc. with respect to the snapshot item selected by a selection command from an operator, thereby displaying the status variable data on a display unit, and compares each of the status variables or a value computed based on a plurality of status variables with a predetermined reference value range. A failure of a corresponding part or the related status variable is displayed on the display unit.

8 Claims, 19 Drawing Sheets

FIG. 12

| MENU ITEM | SENSOR OUTPUT/STATE | TYPE OF SENSOR | REMARKS |
|---|---|---|---|
| OUTPUT DROP OF ENGINE(1) | ENGINE REVOLUTION SPEED | ..... | |
| | THROTTLE POSITION | ..... | |
| | INTAKE MANIFOLD TEMPERATURE | ..... | |
| | INTERCOOLER INLET TEMPERATURE | ..... | |
| | TURBO BOOSTED PRESSURE | ..... | |
| | ENGINE DERATING ON/OFF-STATE | ..... | |
| | OPERATION ON/OFF-STATE | ..... | |
| | OTHERS | ..... | |
| OUTPUT DROP OF ENGINE(2) | ENGINE REVOLUTION SPEED | ..... | |
| | THROTTLE POSITION | ..... | |
| | INTAKE MANIFOLD TEMPERATURE | ..... | |
| | INTERCOOLER INLET TEMPERATURE | ..... | |
| | TURBO BOOSTED PRESSURE | ..... | |
| | ENGINE DERATING ON/OFF-STATE | ..... | |
| | OPERATION ON/OFF-STATE | ..... | |
| | OTHERS | ..... | |
| HEAT BALANCE DROP OF WORKING OIL | WORKING OIL TEMPERATURE | ..... | |
| | OIL COOLER INLET TEMPERATURE | ..... | |
| | OIL COOLER OUTLET TEMPERATURE | ..... | |
| | OIL COOLER OUTLET PRESSURE | ..... | |
| | ..... | ..... | |
| | ..... | ..... | |
| | ..... | ..... | |
| | ..... | ..... | |
| | OTHERS | | |
| EXHAUST TEMPERATURE (PER CYLINDER) | No. 1 TO 20 CYLINDERS | ..... | MAX-MIN DISPLAY PER CYLINDER |
| FUEL CONSUMPTION (LOAD RATIO) | REVOLUTION SPEED OF ENGINE(1) | ..... | |
| | REVOLUTION SPEED OF ENGINE(2) | ..... | |
| | FUEL CONSUMPTION OF ENGINE(1) | ..... | MAX-MIN DISPLAY |
| | FUEL CONSUMPTION OF ENGINE(2) | ..... | MAX-MIN DISPLAY |
| | OPERATION ON/OFF-STATE | ..... | |
| | | | |
| BOOM-RAISING SPEED | BOOM ANGLE | ..... | |
| | BOOM-RAISING OPERATION STATE | ..... | |
| | TIME | ..... | |
| SWING SPEED | SWING OPERATION STATE | ..... | |
| | TIME | ..... | |
| ..... | | ..... | |
| | | | |

FIG. 13

COOLANT
OVERHEAT ALARM

| PARAMETER | TARGET LOCATION/ FACTOR | USAGE/DETERMINATION MATTER |
|---|---|---|
| ATMOSPHERIC TEMPERATURE | BASIC PARAMETER | HEAT BALANCE CONFIRMATION PARAMETER |
| COOLANT TEMPERATURE IN UPPER MANIFOLD | RADIATOR | ENGINE DERATING CONTROL METER INDICATION |
| AIR TEMPERATURE AT RADIATOR FRONT SURFACE | RADIATOR | DETECTING OF CLOGGING, CRACKING, ETC. OF RADIATOR |
| RADIATOR OUTLET TEMPERATURE | RADIATOR | DIFFERANCE |
| INLET PRESSURE OF RADIATOR COOLER FAN MOTOR | FAN PUMP | INLET PRESSURE DROPS WHEN PUMP EFFICIENCY IS REDUCED DUE TO, e.g., LEAK IN FAN PUMP |
| COOLANT PUMP DELIVERY PRESSURE/ UPPER MANIFOLD PRESSURE | COOLANT PUMP | DETECT PRESSURIZATION LEVEL OF COOLANT. IF NOT PRESSURIZED, LEAK OCCURS |
| ENGINE REVOLUTION SPEED | FAN PUMP/ COOLANT PUMP | ENGINE CONTROL IS NORMAL OR NOT |

ABNORMAL COMBUSTION OR
INTAKE/EXHAUST ABNORMALITY ALARM

| PARAMETER | TARGET LOCATION/ FACTOR | USAGE/DETERMINATION MATTER |
|---|---|---|
| EXHAUST TEMPERATURE (PER CYLINDER) | ABNORMAL COMBUSTION IN CYLINDER | DETECT VARIATION WIDTH OF EXHAUST TEMPERATURE WITH ENGINE REVOLUTION |
| ENGINE REVOLUTION SPEED | REVOLUTION SENSOR | ACTUAL REVOLUTION SPEED USED IN ENGINE CONTROL |
| BOOSTED PRESSURE | | MONITOR INFLUENCE OF BOOSTED PRESSURE |
| INTAKE MANIFOLD INLET TEMPERATURE | INTAKE TEMPERATURE | MONITOR INFLUENCE OF INTAKE TEMPERATURE |
| ATMOSPHERIC PRESSURE | PRESSURE OF ATMOSPHERE | INFLUENCE OF ATMOSPHERIC PRESSURE CHANGE |
| ENGINE LOAD RATIO | ENGINE LOAD | CONDITION OF LOAD ACTING ON ENGINE |

..... ..... .....

DIAGNOSTIC INFORMATION PROVIDING APPARATUS FOR CONSTRUCTION MACHINE AND DIAGNOSTIC INFORMATION DISPLAY SYSTEM FOR CONSTRUCTION MACHINE

TECHNICAL FIELD

The present invention relates to a diagnostic information providing apparatus for a construction machine and a diagnostic information display system for a construction machine. More particularly, the present invention relates to a diagnostic information providing apparatus for a construction machine and a diagnostic information display system for a construction machine, such as a large-sized hydraulic excavator.

BACKGROUND ART

A construction machine, in particular a large-sized hydraulic excavator, is used for excavation of earth and stones in a very wide worksite, for example. In general, such a large-sized hydraulic excavator is continuously operated for the purpose of increasing productivity. If any abnormality occurs, the operation of the hydraulic excavator must be stopped for repair. Depending on a degree of the abnormality, it may happen that the operation of the hydraulic excavator must be ceased for a long period. In such a case, because production work using that hydraulic excavator must be suspended, it is required to change steps of a production schedule.

In view of such a situation, a monitoring device for a hydraulic working machine is proposed in which, when an abnormality is detected in, e.g., an engine system, status variables (detection data) related to an engine operating state in a certain period until the detection of the abnormality are selectively stored and accumulated as operation data while being displayed (see, e.g., Patent Document 1). With the proposed related art, abnormality diagnosis can be advantageously made and trouble-shooting can be promptly performed by using the operation data in the certain period until the detection of the abnormality.

Patent Document 1: JP,A 7-119183

DISCLOSURE OF THE INVENTION

Problems to be Solved by the Invention

However, the above-mentioned related art still has room for improvement in the following point.

In the above-mentioned related art, the operation data is acquired only after the detection of the abnormality in the engine system, for example, with intent to utilize the operation data for subsequent failure diagnosis and to promptly perform the trouble-shooting, thereby cutting a suspension time of the hydraulic excavator. Usually, if any abnormality is detected, the operation of the hydraulic excavator must be stopped and, depending on a degree of the abnormality, the operation must be ceased for a long period. On the other hand, as described above, the large-sized hydraulic excavator is required to be continuously operated for the purpose of increasing productivity. In order to meet such a requirement, the suspension period due to a failure has to be reduced as short as possible. Stated another way, when an operator intuitively perceives a sign indicating, e.g., a drop of engine output, there is a possibility of finding an abnormality from the sign before it actually occurs. Nevertheless, the above-mentioned related art does not take into account such a possibility and still has room for further improvement in a point of cutting the suspension period of the hydraulic excavator.

The present invention has been made in consideration of the above-described problems with the related art, and its object is to provide a diagnostic information providing apparatus for a construction machine and a diagnostic information display system for a construction machine, which can find an abnormality before it actually occurs and can reduce the suspension period of the construction machine.

Means for Solving the Problems (1) To achieve the above object, a diagnostic information providing apparatus for a construction machine, according to the present invention, comprises detection means for detecting status variables related to an operating state of the construction machine or ambient environment; storage means for storing combinations between a plurality of snapshot items and one or more status variables related to each of the snapshot items in advance; status variable display control means for acquiring or extracting status variable data, which is regarded as being related based on the stored combinations, from corresponding detected signals of the detection means with respect to the snapshot item selected by a selection command from an operator, thereby displaying the status variable data on display means; failed part determining means for comparing each of the status variables or a value computed based on a plurality of status variables, which are contained in the acquired or extracted status variable data, with a corresponding predetermined reference value range, and determining a failure of a corresponding part when the status variable or the computed value is outside the predetermined reference value range; and failed part display control means for displaying the failed part or the related status variable, which has been determined by the failed part determining means, on the display means.

As a sign representing an abnormality in an engine system, for example, there appears a drop of engine output in some cases. The drop of engine output is intuitively perceived by an operator, but it is generally not detected as an abnormality. In the present invention, when the operator manipulates operating means, e.g., a keypad and commands selection of one snapshot item, the status variable display control means acquires or extracts status variable data, which is related to the selected snapshot item, thereby displaying the status variable data on the display means. On that occasion, the failed part determining means compares each of the status variables or a value computed based on a plurality of status variables, which are contained in the acquired or extracted status variable data (namely, the status variables displayed on the display means), with a corresponding predetermined reference value range (i.e., a predetermined reference value range set and stored in advance). When the status variable or the computed value is outside the predetermined reference value range, the failed part determining means determines a failure of a corresponding part (more specifically, a failure that occurs to such an extent as not generating an abnormality as a detection result). The failed part display control means displays the failed part or the related status variable, which has been determined by the failed part determining means, on the display means.

Thus, according to the present invention, the status variable data related to the snapshot item selected by the selection command from the operator is displayed on the display means, and whether a part corresponding to each status variable is failed is determined. If a failure is determined, the failed part or the related status variable is displayed on the display means. Therefore, the operator can find an abnormality before it actually occurs. Also, any serviceman can easily specify the failed part regardless of experiences and skills of individual servicemen. As a result, it is possible to cut the operation suspended time of a hydraulic excavator, and to increase productivity.

(2) Also, to achieve the above object, a diagnostic information providing apparatus for a construction machine, according to the present invention, comprises detection means for detecting status variables related to an operating state of the construction machine or ambient environment; storage means for storing combinations between a plurality of snapshot items and one or more status variables related to each of the snapshot items in advance; recording means for acquiring or extracting status variable data, which is regarded as being related based on the stored combinations and falls within a predetermined time, from corresponding detected signals of the detection means with respect to the snapshot item selected by a selection command from an operator, thereby recording the status variable data in the storage means; status variable display control means for playing back and displaying changes of the status variable data, which is stored in the storage means and falls within the predetermined time, on the display means in accordance with a command from an operator; failed part determining means for comparing each of the status variables or a value computed based on a plurality of status variables, which are contained in the status variable data falling within the predetermined time, with a corresponding predetermined reference value range, and determining a failure of a corresponding part when the status variable or the computed value is outside the predetermined reference value range; and failed part display control means for displaying the failed part or the related status variable, which has been determined by the failed part determining means, on the display means.

With the present invention, for example, in the case of the operator intuitively perceiving a sign indicating an abnormality, e.g., a drop of engine output, during the operation, when the operator manipulates operating means, e.g., a keypad and commands selection of one snapshot item, the recording means acquires or extracts the status variable data related to the selected snapshot item and falling within the predetermined time (i.e., the so-called manual snapshot data) in the storage means. Thereafter, when a serviceman, for example, manipulates the operating means, e.g., the keypad and selects the manual snapshot data which is stored in the storage means and falls within the predetermined time, the status variable display control means plays back and displays changes of the status variable data falling within the predetermined time on the display means. On that occasion, the failed part determining means compares each of the status variables or a value computed based on a plurality of status variables, which are contained in the status variable data falling within the predetermined time (namely, the status variables displayed on the display means), with a corresponding predetermined reference value range. When the status variable or the computed value is outside the predetermined reference value range, the failed part determining means determines a failure of a corresponding part. The failed part display control means displays the failed part or the related status variable, which has been determined by the failed part determining means, on the display means.

Thus, according to the present invention, changes of the status variable data stored in the storage means and falling within the predetermined time are played back and displayed in accordance with the command from the operator, and whether a part corresponding to each status variable is failed is determined. If a failure is determined, the failed part or the related status variable is displayed on the display means. Therefore, the operator can find an abnormality before it actually occurs. Also, any serviceman can easily specify the failed part regardless of experiences and skills of individual servicemen. As a result, similarly to the case of above (1), it is possible to cut the operation suspended time of a hydraulic excavator, and to increase productivity.

(3) In above (1) or (2), preferably, the failed part determining means compares the status variable or the computed value with each of a plurality of corresponding reference value ranges to determine a failure in a stepwise manner, and the failed part display control means displays a stage of the failure, which have been determined by the failed part determining means, on the display means.

(4) In any one of above (1) to (3), preferably, the status variable display control means displays changes of the status variable and a minimum value and a maximum value of the status variable within a predetermined time.

(5) Further, to achieve the above object, a diagnostic information display system for a construction machine, according to the present invention, comprises detection means for detecting status variables related to an operating state of a construction machine or ambient environment; display means disposed inside a cab of the hydraulic excavator; storage means for storing combinations between a plurality of snapshot items and one or more status variables related to each of the snapshot items in advance; status variable display control means for acquiring or extracting status variable data, which is regarded as being related based on the stored combinations, from corresponding detected signals of the detection means with respect to the snapshot item selected by a selection command from an operator, thereby displaying the status variable data on the display means; failed part determining means for comparing each of the status variables or a value computed based on a plurality of status variables, which are contained in the acquired or extracted status variable data, with a corresponding predetermined reference value range, and determining a failure of a corresponding part when the status variable or the computed value is outside the predetermined reference value range; and failed part display control means for displaying the failed part or the related status variable, which has been determined by the failed part determining means, on the display means.

(6) Still further, to achieve the above object, a diagnostic information display system for a construction machine, according to the present invention, comprises detection means for detecting status variables related to an operating state of a construction machine or ambient environment; display means disposed inside a cab of the hydraulic excavator; storage means for storing combinations between a plurality of snapshot items and one or more status variables related to each of the snapshot items in advance; recording means for acquiring or extracting status variable data, which is regarded as being related based on the stored combinations and falls within a predetermined time, from corresponding detected signals of the detection means with respect to the snapshot item selected by a selection command from an operator, thereby recording the status variable data in the storage means; status variable display control means for playing back and displaying changes of the status variable data, which is stored in the storage means and falls within the predetermined time, on the display means in accordance with a command from an operator; failed part determining means for comparing each of the status variables or a value computed based on a plurality of status variables, which are contained in the status variable data falling within the predetermined time, with a corresponding predetermined reference value range, and determining a failure of a corresponding part when the status variable or the computed value is outside the predetermined reference value range; and failed part display control means for displaying the failed part or the related status variable, which has been determined by the failed part determining means, on the display means.

(7) In above (5) or (6), preferably, the failed part determining means compares the status variable or the computed value with each of a plurality of corresponding reference value ranges to determine a failure in a stepwise manner, and the failed part display control means displays a stage of the failure, which have been determined by the failed part determining means, on the display means.

(8) In any one of above (5) to (7), preferably, the status variable display control means displays changes of the status variable and a minimum value and a maximum value of the status variable within a predetermined time.

Advantages of the Invention

According to the present invention, the status variable data related to the snapshot item or the status variable data stored in the storage means and falling within the predetermined time is displayed on the display means, and whether a part corresponding to each status variable is failed is determined. If a failure is determined, the failed part or the related status variable is displayed on the display means. Therefore, the operator can find an abnormality before it actually occurs. Also, any serviceman can easily specify the failed part regardless of experiences and skills of individual servicemen. As a result, it is possible to cut the operation suspended time of a hydraulic excavator, and to increase productivity.

BRIEF DESCRIPTION OF THE DRAWINGS

FIG. 12 is a table showing one example of combinations of manual snapshot items and a plurality of status variables corresponding to each of the formers in the controller which constitutes one embodiment of the diagnostic information providing apparatus for the construction machine according to the present invention.

FIG. 13 is a table showing one example of combinations of alarm/failure items and a plurality of status variables corresponding to each of the formers in an automatic snap shot.

REFERENCE NUMERALS

1 hydraulic excavator

2 controller (storage means, status variable display control means, failed part determining means, failed part display control means, and recording means)

40-46 sensors (detection means)

47*a*-47*c* sensors (detection means)

50 display unit (display means)

BEST MODE FOR CARRYING OUT THE INVENTION

One embodiment of a diagnostic information providing apparatus for a construction machine according to the present invention will be described below with reference to the drawings.

Figure 1:
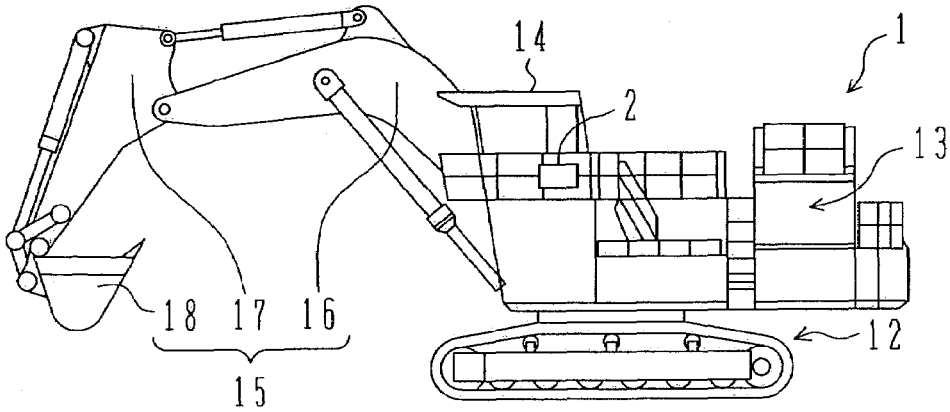
FIG. 1 is a side view showing a structure of a construction machine to which is applied one embodiment of a diagnostic information providing apparatus for a construction machine according to the present invention.

FIG. 1 is a side view showing a structure of a construction machine (hydraulic excavator in this exemplary case) to which is applied one embodiment of the diagnostic information providing apparatus for the construction machine according to the present invention.

A hydraulic excavator 1 comprises a track body 12, a swing body 13 installed on the track body 12 in a swingable manner, a cab 14 installed in a front portion of the swing body 13 on the left side, and a front operating mechanism (excavating device) 15 mounted to a front central portion of the swing body 13 in a vertically rotatable manner. The front operating mechanism 15 is made up of a boom 16 rotatably mounted to the swing body 13, an arm 17 rotatably mounted to a fore end of the boom 16, and a bucket 18 rotatably mounted to a fore end of the arm 17. A (machine-side) controller 2 is installed in the cab 14.

While the hydraulic excavator 1 is shown in FIG. 1 as being, by way of example, a super-large sized excavator (backhoe type) which has machine weight of a several-hundreds-ton class and is used in mines or stone pits in many cases, the present invention is not limited to such an application. In other words, the present invention is also applicable to, e.g., the so-called large-sized excavators having machine weights of a several-tens-ton class and being most prevalently used in various construction work sites or stone pits, medium-sized excavators, and the so-called mini-excavators having smaller sizes and employed in small-scale work sites.

Figure 2:
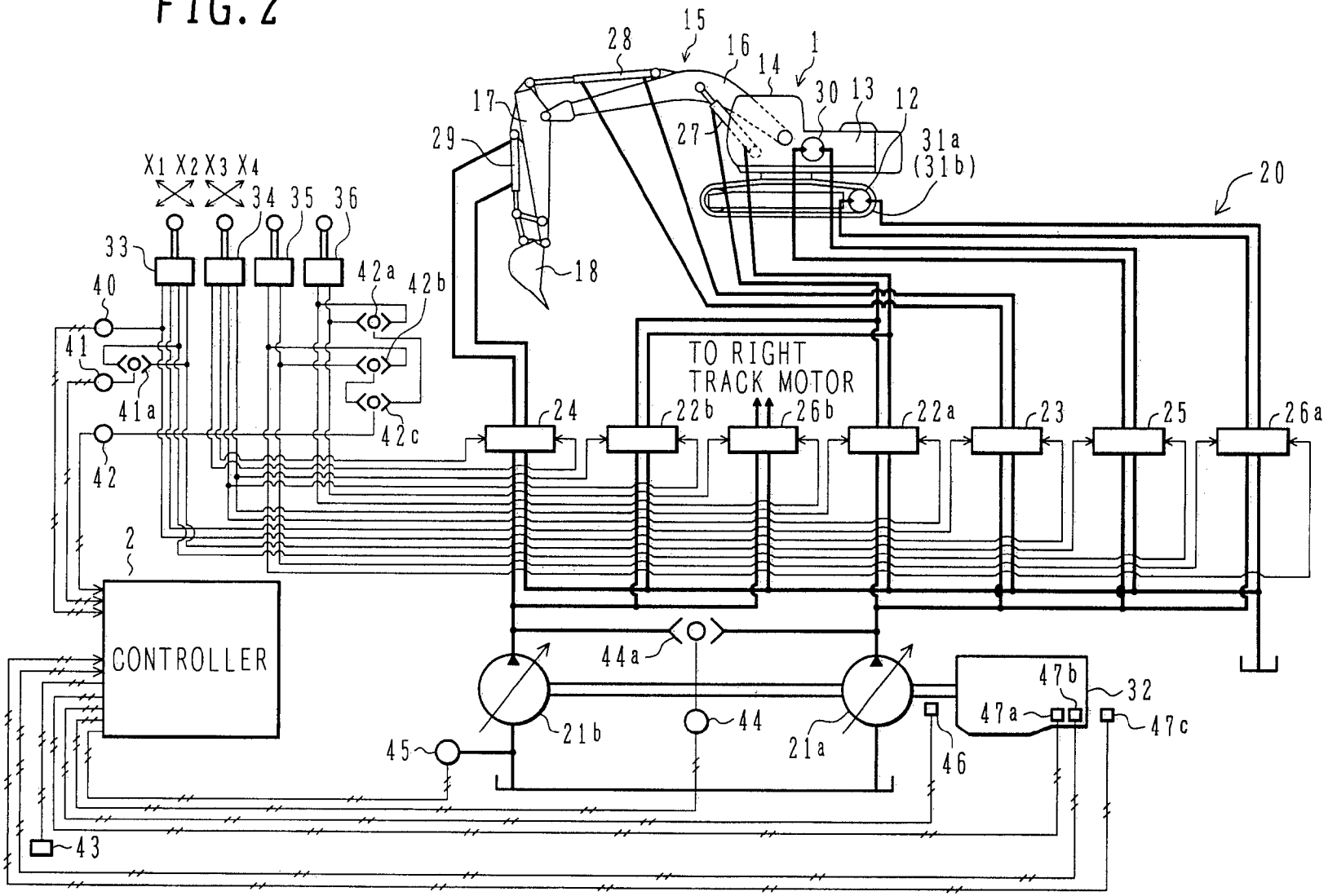
FIG. 2 is a diagram schematically showing, along with sensors, one example of a hydraulic system installed in a hydraulic excavator to which is applied one embodiment of the diagnostic information providing apparatus for the construction machine, shown in FIG. 1, according to the present invention.

FIG. 2 is a diagram schematically showing, along with sensors, one example of a hydraulic system installed in the hydraulic excavator 1 to which is applied one embodiment of the diagnostic information providing apparatus for the construction machine, shown in FIG. 1, according to the present invention.

In FIG. 2, a hydraulic system 20 installed in the hydraulic excavator 1 comprises, for example, hydraulic pumps 21*a*, 21*b*, boom control valves 22*a*, 22*b*, an arm control valve 23, a bucket control valve 24, a swing control valve 25, track control valves 26*a*, 26*b*, a boom cylinder 27, an arm cylinder 28, a bucket cylinder 29, a swing motor 30, and track motors 31*a*, 31*b*.

The hydraulic pumps 21*a*, 21*b* are rotated, for delivery of a hydraulic fluid, by two diesel engines 32 (only one of which is shown in FIG. 2, hereinafter referred to simply as an "engine 32" as required) each provided with a fuel injector (not shown) of the so-called electronic governor type. The control valves 22*a*, 22*b*-26*a*, 26*b* control flow (flow rate and flow direction) of the hydraulic fluid supplied from the hydraulic pumps 21*a*, 21*b* to the hydraulic actuators 27-31*a*, 31*b*. The hydraulic actuators 27-31*a*, 31*b* drive the boom 16, the arm 17, the bucket 18, the swing body 13, and the track body 12. The hydraulic pumps 21*a*, 21*b*, the control valves 22*a*, 22*b*-26*a*, 26*b*, and the engine 32 are installed in an accommodation room (engine room) formed in a rear portion of the swing body 13.

Control lever units 33, 34, 35 and 36 are disposed respectively in association with the control valves 22*a*, 22*b*-26 *a*, 26*b*. When a control lever of the control lever unit 33 is manipulated in one direction X1 of perpendicularly crossed directions, an arm-crowding pilot pressure or an arm-dumping pilot pressure is produced and applied to the arm control valve 23. When the control lever of the control lever unit 33 is manipulated in the other direction X2 of the perpendicularly crossed directions, a rightward-swing pilot pressure or a leftward-swing pilot pressure is produced and applied to the swing control valve 25.

When a control lever of the control lever unit 34 is manipulated in one direction X3 of perpendicularly crossed directions, a boom-raising pilot pressure or a boom-lowering pilot pressure is produced and applied to the boom control valves 22*a*, 22*b*. When the control lever of the control lever unit 34 is manipulated in the other direction X4 of the perpendicularly crossed directions, a bucket-crowding pilot pressure or a bucket-dumping pilot pressure is produced and applied to the bucket control valve 24. Further, when control levers of the control lever units 35, 36 are manipulated, a left-track pilot pressure and a right-track pilot pressure are produced and applied to the track control valves 26*a*, 26*b*. Incidentally, the control lever units 33-36 are disposed in the cab 14 along with the controller 2.

Sensors 40-46, 47*a*, 47*b*, 47*c*, etc. are disposed in the hydraulic system 20 constructed as described above. The sensor 40 is a pressure sensor for detecting, as an operation signal of the front operating mechanism 15, the boom-raising pilot pressure in this embodiment. The sensor 41 is a pressure sensor for detecting, as a swing operation signal, the swing pilot pressure taken out through a shuttle valve 41*a*. The sensor 42 is a pressure sensor for detecting, as a track operation signal, the track pilot pressure taken out through shuttle valves 42*a*, 42*b* and 42*c*.

The sensor 43 is a sensor for detecting the on/off state of a key switch of the engine 32, the sensor 44 is a pressure sensor for detecting the delivery pressure of the hydraulic pumps 21*a*, 21*b*, i.e., the pump pressure, taken out through a shuttle valve 44*a*, and the sensor 45 is an oil temperature sensor for detecting the temperature of working oil (i.e., oil temperature) in the hydraulic system 20. The sensor 46 is a revolution speed sensor for detecting the revolution speed of the engine 32. The sensor 47*a* is a fuel sensor for detecting the amount of fuel injected by the fuel injector (i.e., fuel consumption), the sensor 47*b* is a pressure sensor for detecting the turbo boosted pressure of the engine 32, and the sensor 47*c* is a temperature sensor for detecting the temperature of coolant (radiator water) for cooling the engine 32 (e.g., the temperature in an upper manifold or the temperature at an outlet). In addition, though not shown for the sake of brevity of the drawing, there are disposed other various sensors, e.g., a sensor for detecting the exhaust temperature for each cylinder, a sensor for detecting the throttle position of an electronic governor, a sensor for detecting a fuel level, a sensor for detecting a battery voltage, a sensor for detecting the temperature of an intake manifold, a sensor for detecting the pressure in the upper manifold of the radiator, a sensor for detecting the air temperature at a front surface of the radiator, a sensor for detecting the inlet pressure (hydraulic pressure) of a hydraulic motor for a fan for cooling the radiator, a sensor for detecting the delivery pressure of a coolant pump, a sensor for detecting the temperature of an intercooler, and sensors for detecting the inlet and outlet temperatures and the outlet pressure of an oil cooler, which are associated with the engine 32, a sensor for detecting a boom angle, which is associated with the boom 16, as well as a sensor for detecting the atmospheric pressure and a sensor for detecting the atmospheric temperature, which are associated with the ambient environment. Signals detected by those sensors 40-46, 47*a*, 47*b*, 47*c*, etc. (hereinafter referred to simply as the "sensor 40, etc." as required) are all sent to and collected in the controller 2.

While the above description has been made, by way of example, in connection with the case of the control levers being each of the hydraulic pilot type, the present invention is not limited to that case, and each control lever may be of the so-called electric lever type. In such a modification, a signal representing the operating state is obtained by, instead of detecting the pilot pressure, using an electric output (command signal) from a control lever unit of the electric lever type as it is.

The controller 2 collects the status variables related to the operating state of the hydraulic excavator 1 and the ambient environment, which are detected by the sensor 40, etc., and it displays various kinds of information in the cab 14 based on the detected results. The most important feature of this embodiment resides in display mode for presenting the information in the cab 14.

Figure 3:
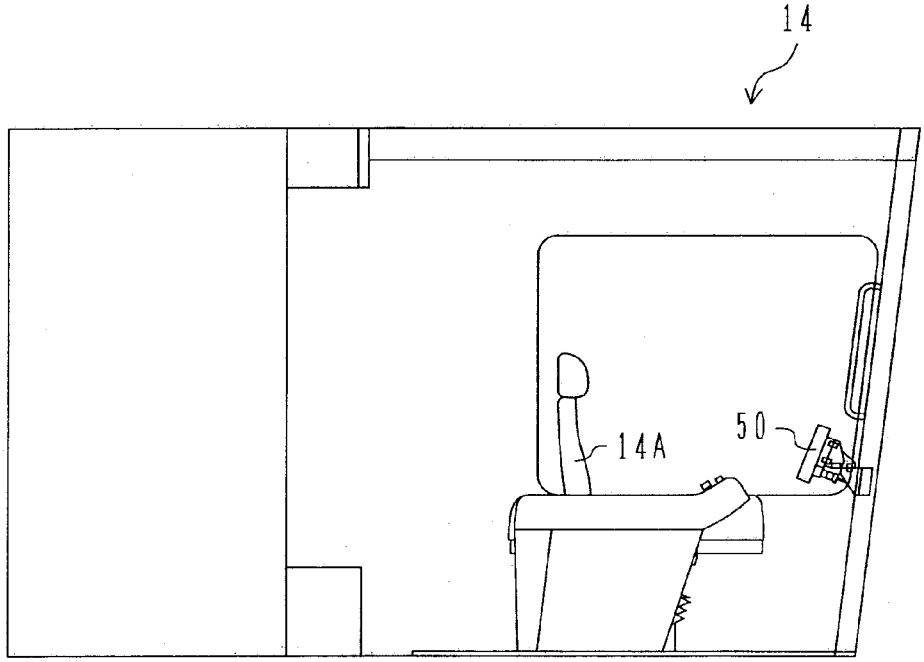
FIG. 3 is a side view showing an interior construction of a cab installed in the hydraulic excavator, shown in FIG. 1, to which is applied one embodiment of the diagnostic information providing apparatus for the construction machine according to the present invention.
Figure 4:
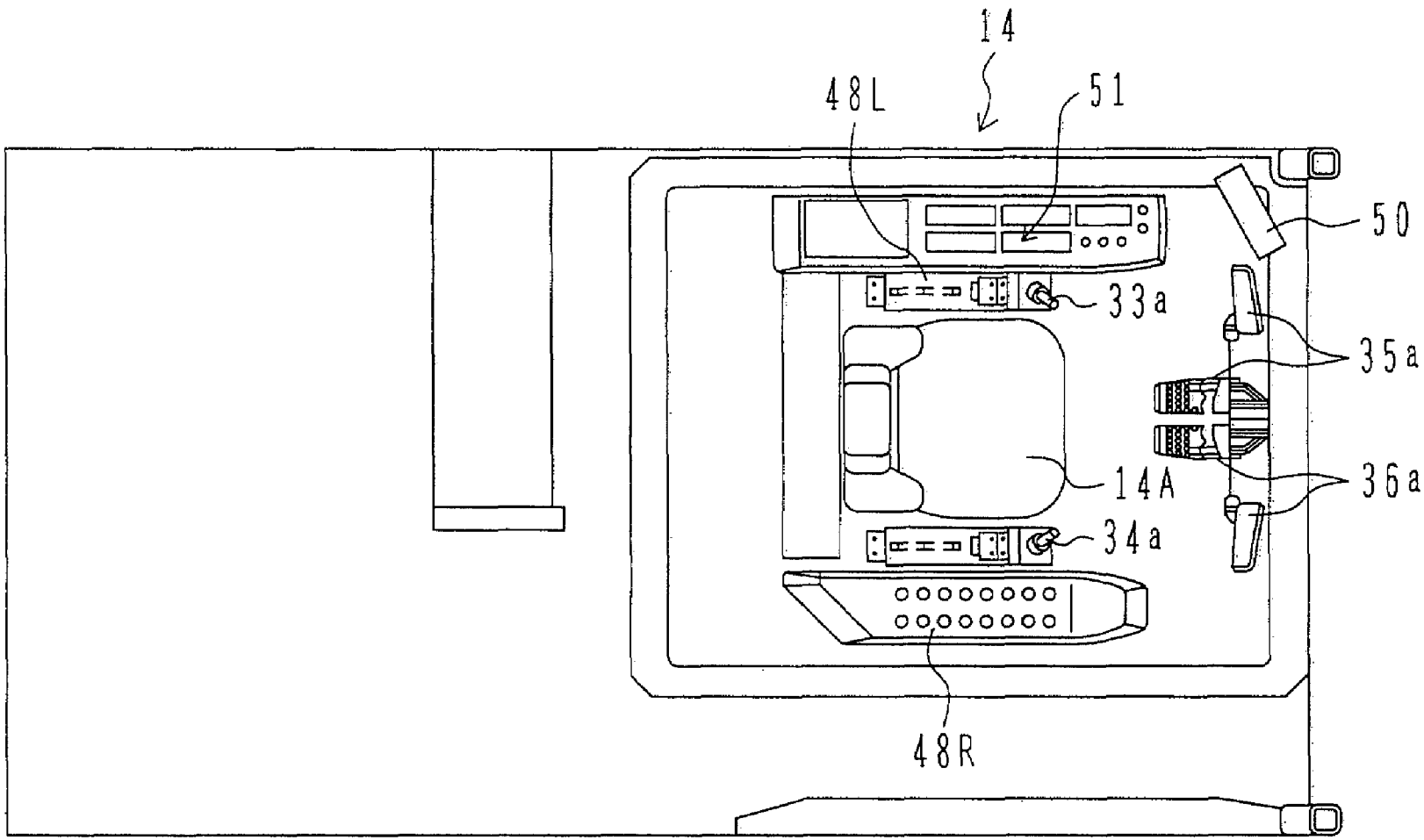
FIG. 4 is a plan view showing the interior construction of the cab installed in the hydraulic excavator, shown in FIG. 1, to which is applied one embodiment of the diagnostic information providing apparatus for the construction machine according to the present invention.

FIGS. 3 and 4 are respectively a side view and a plan view showing an interior construction of the cab installed in the hydraulic excavator, shown in FIG. 1, to which is applied one embodiment of the diagnostic information providing apparatus for the construction machine according to the present invention.

In FIGS. 3 and 4, left and right track control levers 35*a*, 36*a* of the track control lever units 35, 36, which can be manipulated by either a hand or a foot, are disposed in front of a seat 14A within the cab 14 on which the operator sits. Also, left and right manual control levers 33*a*, 34*a* of the control lever units 33, 34, which are each manipulated in perpendicularly crossed directions, are disposed on the left and right sides of the seat 14A. A left console 48L is disposed on the left side of the seat 14A, and a right console 48R is disposed on the right side of the seat 14A.

Within the cab 14, a display unit 50 and a keypad 51 are further disposed as display means and operating means, respectively, which constitute principal components of the diagnostic information providing apparatus for the construction machine according to the present invention. The display unit 50 is disposed on a front wall of the cab 14 in a position that is located forward of the operator sitting in the cab 14 on the left side and is located at a level slightly higher than the control lever 33*a* in the vertical direction. The keypad 51 is disposed leftward of the control lever 33*a* and the left console 48L which are disposed on the left side of the seat 14A.

Additionally, the controller 2 is placed in an appropriate position within the cab 14 (e.g., under the seat 14A).

Figure 5:
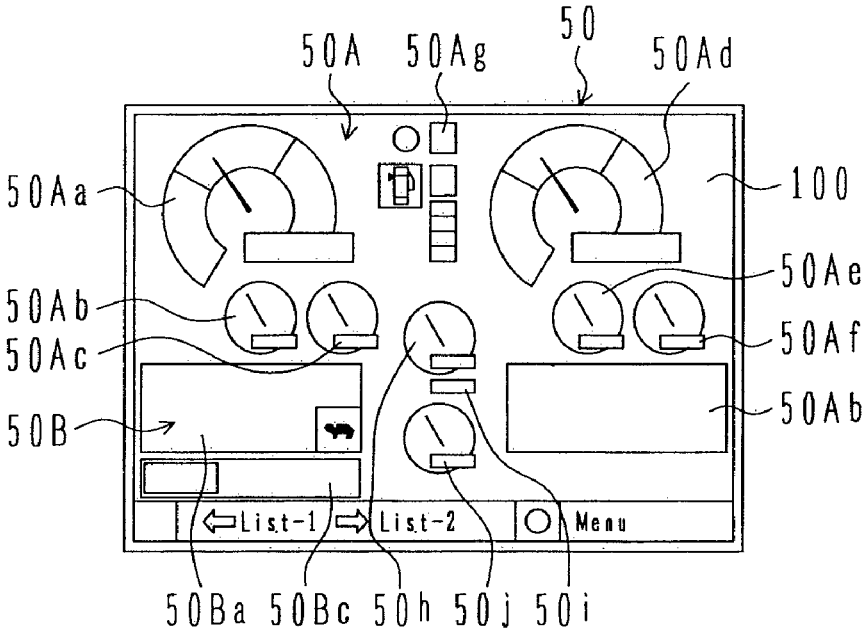
FIG. 5 is a front view showing an ordinary screen (=initial screen) display state of a display unit after power-on, which constitutes one embodiment of the diagnostic information providing apparatus for the construction machine according to the present invention.

FIG. 5 is a front view showing an ordinary screen (=initial screen) display state of the display unit 50 after power-on, which constitutes one embodiment of the diagnostic information providing apparatus for the construction machine according to the present invention.

As shown in FIG. 5, in the state where an initial screen 100 is displayed after power-on, the display unit 50 has a basic data display area 50A for displaying the least necessary basic data during ordinary operation, and an alarm/failure display area 50B.

The basic data display area 50A includes a tachometer display area 50Aa, a radiator coolant temperature display area 50Ab, and a turbo boosted pressure display area 50Ac for one engine 32 of the two engines, a tachometer display area 50Ad, a radiator coolant temperature display area 50Ae, and a turbo boosted pressure display area 50Af for the other engine 32, a fuel level display area 50Ag, a working oil temperature display area 50Ah, an atmospheric temperature display area 50Ai, and a battery voltage display area 50Aj.

The alarm/failure display area 50B includes an alarm display area 50Ba for displaying alarms related to one engine 32 of the two engines and various indicators, an alarm display area 50Bb for displaying alarms related to the other engine 32 and the hydraulic system, and a failure display area 50Bc for displaying an abnormality (in the form of, e.g., a preset failure code) in any component of control equipment and a communication system, such as the sensor 40, etc. and the controller 2.

Figure 6:
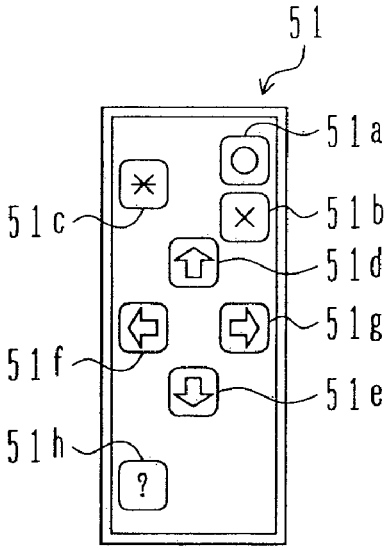
FIG. 6 is a front view showing a detailed arrangement of a keypad which constitutes one embodiment of the diagnostic information providing apparatus for the construction machine according to the present invention.

FIG. 6 is a front view showing a detailed arrangement of the keypad 51 which constitutes one embodiment of the diagnostic information providing apparatus for the construction machine according to the present invention.

As shown in FIG. 6, the keypad 51 includes various operating buttons, i.e., a "○" button 51*a*, a "x" button 51*b*, a "*" button 51*c*, an upward cursor "↑" button 51*d*, a downward cursor "↓" button 51*e*, a leftward cursor "←" button 51*f*, a rightward cursor "→" button 51*g*, and a "?" button 51*h*. When the operator manipulates any of those buttons by touching it with a hand, a corresponding operational signal X is outputted to the controller 2.

Figure 7:
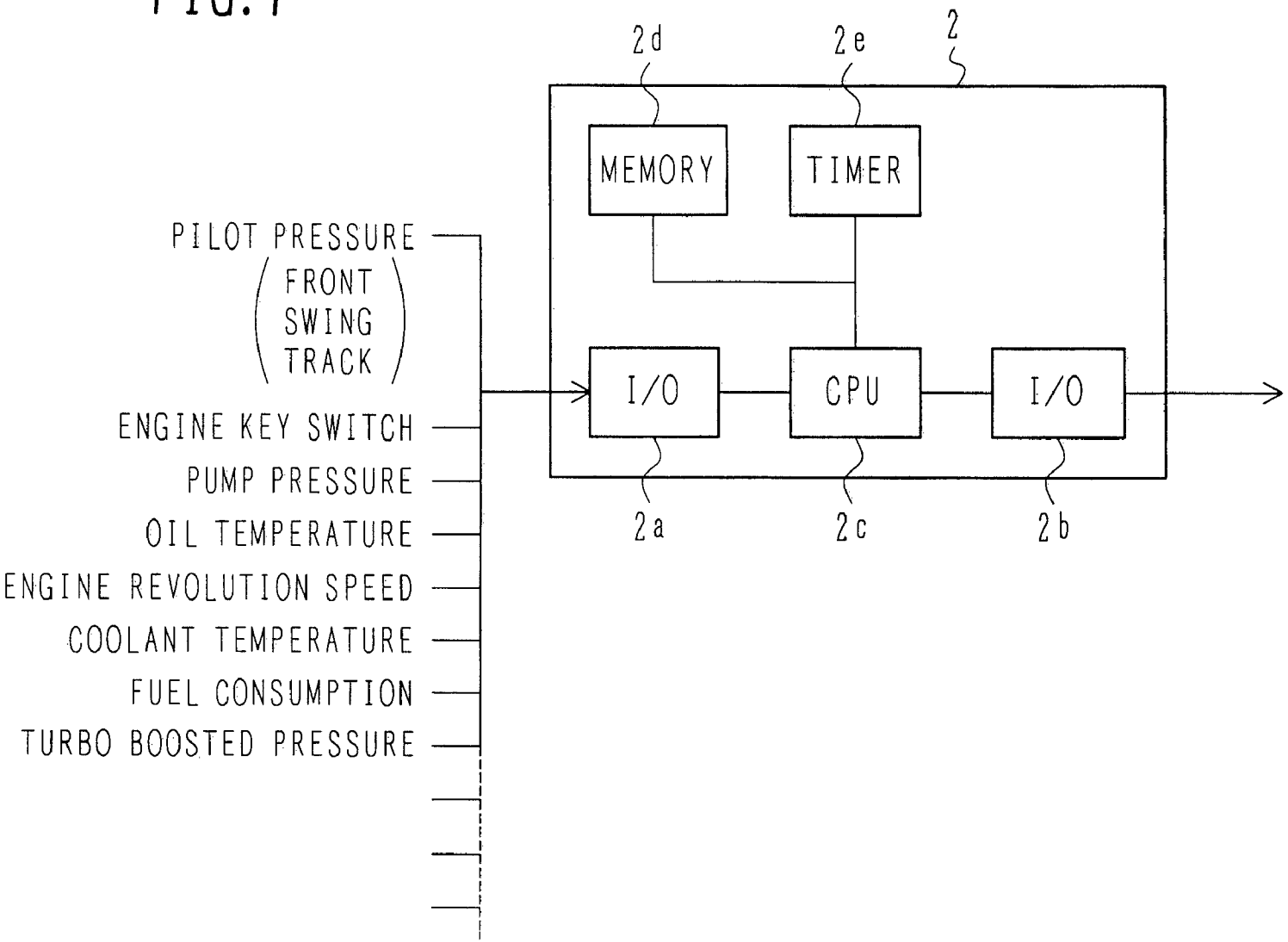
FIG. 7 is a block diagram showing a functional arrangement of a controller which constitutes one embodiment of the diagnostic information providing apparatus for the construction machine according to the present invention.

FIG. 7 is a block diagram showing a functional configuration of the controller 2 which constitutes one embodiment of the diagnostic information providing apparatus for the construction machine according to the present invention.

In FIG. 7, the controller 2 comprises input/output interfaces 2*a*, 2*b*, a CPU (Central Processing Unit) 2*c*, a memory 2*d*, and a timer 2*e*.

The input/output interface 2*a* receives, from the sensor 40, etc., detected signals of the pilot pressures for the front operating mechanism 15, the swing and the track, a detected signal of key-switch-on for the engine 32, detected signals of the pump pressures of the pumps 21*a*, 21*b*, a detected signal of the oil temperature, a detected signal of the revolution speed of the engine 32, a detected signal of the coolant temperature, a detected signal of the fuel consumption, a detected signal of the turbo boosted pressure, a detected signal of the exhaust temperature of the engine 32, a detected signal of the throttle position, a detected signal of the intake manifold temperature, a detected signal of the pressure in the upper manifold of the radiator, a detected signal of the air temperature at the front surface of the radiator, a detected signal of the inlet pressure of the hydraulic motor for a fan for cooling the radiator, a detected signal of the delivery pressure of the coolant pump, a detected signal of the intercooler temperature, detected signals of the inlet and outlet temperatures and the outlet pressure of the oil cooler, a detected signal of the boom angle, a detected signal of the atmospheric pressure, a detected signal of the atmospheric temperature, and so on. Additionally, when the engine 32 is in a state of derating control (=known control of reducing an engine output when, for example, the coolant is overheated or the oil pressure is lowered), the controller may also monitor such a state by detecting a derating control signal and receive the detected derating control signal for use in other control.

The CPU 2*c* executes predetermined arithmetic and logical processing based on those detected signals and stores the processing results in the memory 2*d*. In that process, the CPU 2*c* employs the timer (including the clock function) 2*e* as required. Also, the timer 2*e* may be used to set the interval (period) for taking in the detected signals from the sensor 40, etc.

Though not shown, the controller 2 further comprises a ROM serving as a recording medium which stores control programs for operating the CPU 2*c* so as to execute the predetermined arithmetic and logical processing, and a RAM serving as storage means which temporarily stores data in the course of the processing.

Figure 8:
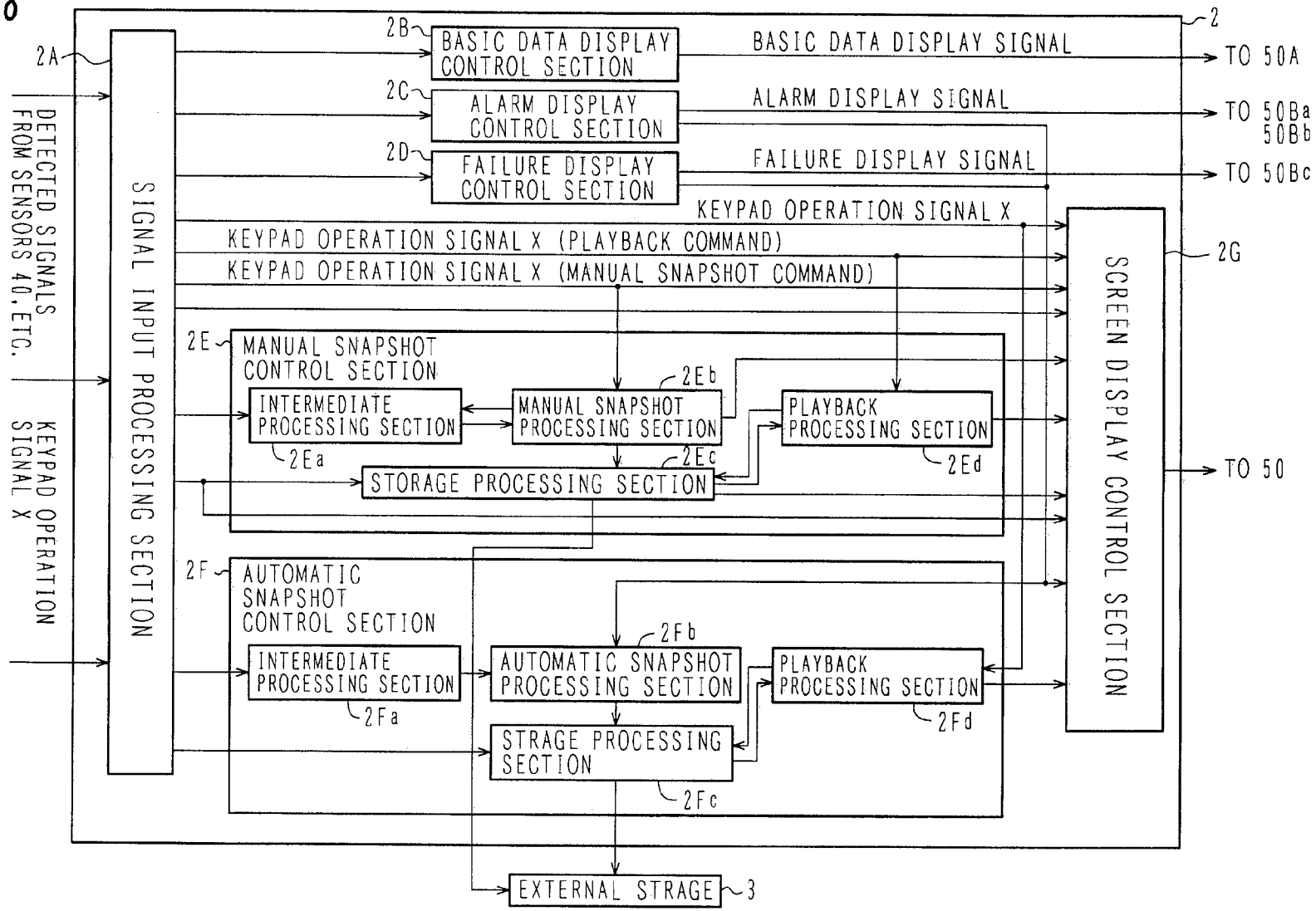
FIG. 8 is a functional block diagram showing processing functions of the controller which constitutes one embodiment of the diagnostic information providing apparatus for the construction machine according to the present invention.

FIG. 8 is a functional block diagram showing processing functions of the controller 2 which constitutes one embodiment of the diagnostic information providing apparatus for the construction machine according to the present invention.

In FIG. 8, the controller 2 includes a signal input processing section 2A, a basic data display control section 2B, an alarm display control section 2C, a failure display control section 2D, a manual snapshot control section 2E, an automatic snapshot control section 2F, and a screen display control section 2G.

The signal input processing section 2A takes in the detected signals from the sensor 40, etc. and the operational signal X from the keypad 51, and outputs those signals to the control sections 2B-2G after executing a predetermined reception process.

The basic data display control section 2B corresponds to the basic data display area 50A (see FIG. 5 described above) of the initial screen 100 on the display unit 50. Based on the detected signals of the engine revolution speeds, the detected signals of the radiator coolant temperatures, the detected signals of the turbo boosted pressures, the detected signal of the fuel level, the detected signal of the working oil temperature, the detected signal of the atmospheric temperature, and the detected signal of the battery voltage from the sensors 45, 46, 47*b*, 47*c*, etc., the basic data display control section 2B outputs display signals (basic data display signals) for presenting indications corresponding to the detected status variables (basic data) to the tachometer display areas 50Aa, 50Ad, the radiator coolant temperature display areas 50Ab, 50Ae, the turbo boosted pressure display areas 50Ac, 50Af, the fuel level display area 50Ag, the working oil temperature display area 50Ah, the atmospheric temperature display area 50Ai, and the battery voltage display area 50Aj on the display unit 50.

The alarm display control section 2C corresponds to the alarm data display areas 50Ba, 50Bb (see FIG. 5 described above) of the initial screen 100 on the display unit 50 and has an alarm on/off determining function and an alarm display signal producing function.

The alarm on/off determining function determines, based on the detected signals (status variable data) from the sensor 40, etc., whether each of the detected signals is within a preset threshold range (i.e., a range where an abnormality is not detected). If the detected signal is not within the preset threshold range, this is determined as indicating a state where an alarm is to be issued (i.e., an abnormal state), and alarm information is outputted to the alarm display signal producing function.

The alarm display signal producing function receives the alarm information and outputs display signals (alarm display signals) for presenting corresponding alarm indications to the alarm display areas 50Ba, 50Bb on the display unit 50. In the alarm display areas 50Ba, 50Bb, each alarm is indicated in the form of, e.g., an alarm mark preset in relation to the kind of the alarm. Although a detailed description of individual alarms is omitted here, examples of alarms regarding the engine 32, which are in common to both the alarm display areas 50Ba, 50Bb, include a fuel level drop alarm, a radiator coolant level drop alarm, a radiator coolant overheat alarm, and an engine exhaust temperature overheat alarm. Examples of alarms regarding the hydraulic system, which belong to the alarm display area 50Bb, include a working oil level drop alarm and a working oil overheat alarm.

Of the above-described two functions, the alarm on/off determining function may be separately provided outside the controller 2. In other words, each sensor may determine by itself, based on comparison with a threshold, whether the detected signal is normal or abnormal, and if an abnormality is determined, it may transmit alarm information to the alarm display signal producing function of the controller 2. As an alternative, another control unit (sub-controller) may be provided for each sensor (or each sensor group comprising a plurality of sensors related to each other to some extent) to make a similar determination and transmit the alarm information to the controller 2.

The alarm display signals produced by the alarm display signal producing function are also inputted to the screen display control section 2G for presenting various kinds of indications when a screen image of the display unit 50 is shifted from the initial screen 100 to an alarm list screen or other subsequent screen with manipulation of the operator (as described later).

The failure display control section 2D corresponds to the failure display areas 50Bc (see FIG. 5 described above) in the initial screen 100 of the display unit 50 and has a failure presence/absence determining function and a failure display signal producing function.

The failure presence/absence determining function determines, based on the detected signals (status variable data) from the sensor 40, etc., whether each of the detected signals indicates a failed state. As a determination method, failed states are classified, for example, into failure modes given below:

(1) the case where the status variable data is not stabilized and unstable;
(2) the case where the voltage level of the detected signal is too high or short-circuited to the high voltage side;
(3) the case where the voltage level of the detected signal is too low or short-circuited to the low voltage side;
(4) the case where the current level of the detected signal is too low or the circuit is opened;
(5) the case where the current level of the detected signal is too high or short-circuited to the ground side;
(6) the case where a mechanical response is failed (the difference between a target value and an actually measured value is too large); and
(7) the case where the frequency, the pulse width or the cycle is abnormal;

When any of the above conditions is met, this is determined as indicating the presence of a failure and the failure information is outputted to the failure display signal producing function.

The failure display signal producing function receives the failure information and outputs display signals (failure display signals) for presenting corresponding failure indications to the failure display area 50Bc on the display unit 50. In the failure display area 50Bc, each failure is indicated (in the form of a failure code) using, e.g., the number representing a location where the failure has occurred and the above-mentioned failure mode number. Although details of individual failures are not described here, the failures generally include short-circuiting or disconnection of the sensor 40, etc. or cables connected to them, a communication failure in the communication system, an abnormality of the controller 2 itself, an abnormality/sticking (seizure) in a neutral position of a valve spool, and so on.

As in the alarm display control section 2C, of the above-described two functions, the failure presence/absence determining function may be separately provided outside the controller 2. In other words, each sensor may determine by itself based on the self-monitoring function whether the detected signal is normal or abnormal, and if an abnormality is determined, it may transmit alarm information to the failure display signal producing function of the controller 2. As an alternative, another control unit (sub-controller) may be provided for each sensor (or each sensor group comprising a plurality of sensors related to each other to some extent) to make a similar determination and transmit the failure information to the controller 2.

The failure display signals produced by the failure display signal producing function are also inputted to the screen display control section 2G for presenting various kinds of indications when a screen image of the display unit 50 is shifted from the initial screen 100 to a failure list screen or other subsequent screen with manipulation of the operator (as described later).

The screen display control section 2G has a layout control function for an entire screen of the display unit 50. The screen display control section 2G displays an entire layout (including a portion indicating the status variable data and a portion indicating a frame and a form except for indication itself of an alarm/failure) on the initial screen 100. Also, the screen display control section 2G outputs, to the display unit 50, display control signals corresponding to the keypad operational signal X, a manual snapshot start command signal and an automatic snapshot start command signal which are directly inputted from the signal input processing section 2A, various display signals (described later) from the manual snapshot control section 2E and the automatic snapshot control section 2F, as well as the alarm display signals from the alarm display control section 2C and the failure display signals from the failure display control section 2D, thereby changing over the display such that the screen image is shifted from the initial screen 100 to another screen.

Figure 9:
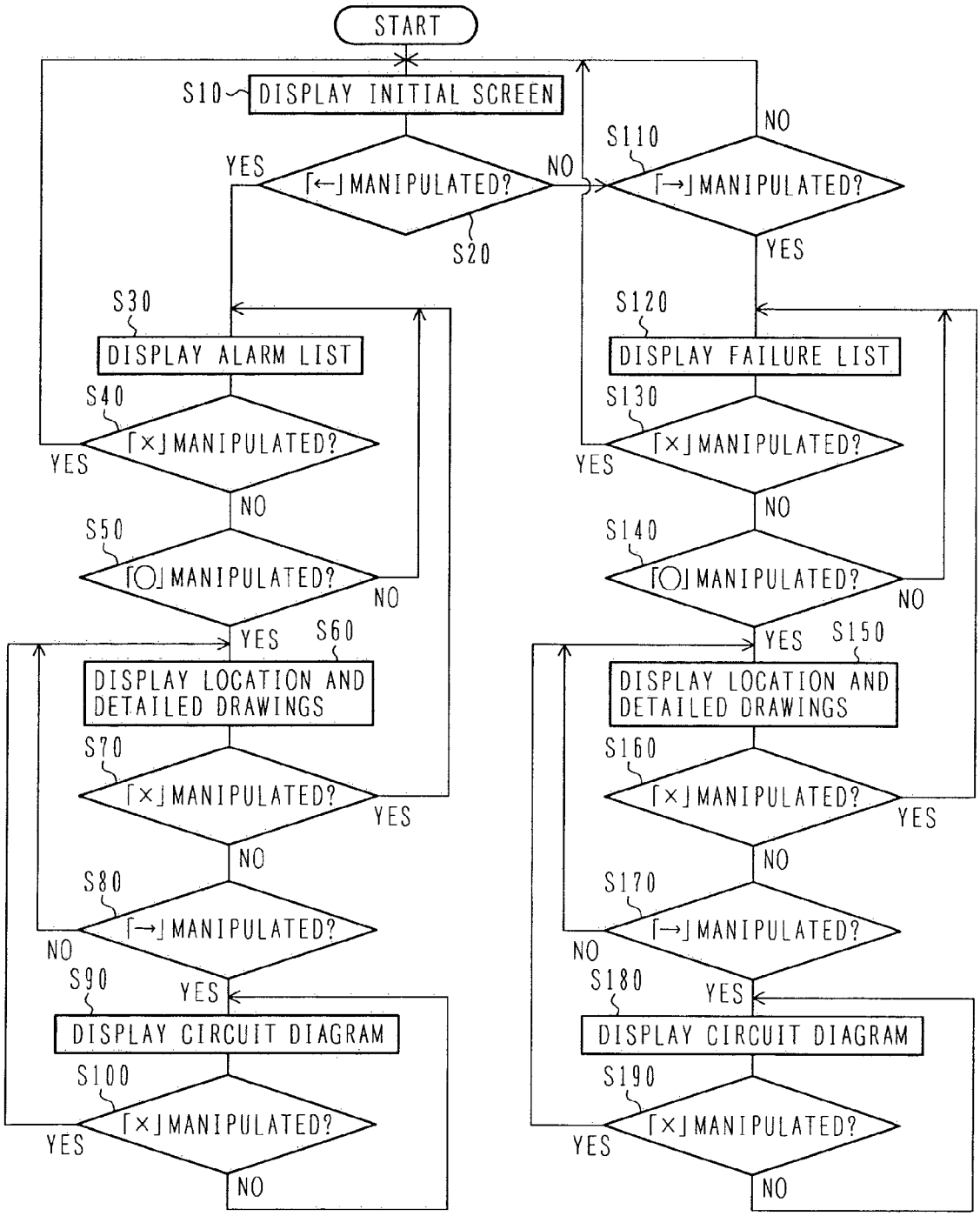
FIG. 9 is a flowchart showing control procedures for an alarm display-side screen shift function and a failure display-side screen shift function of a screen display control section provided in the controller which constitutes one embodiment of the diagnostic information providing apparatus for the construction machine according to the present invention.
Figure 10:
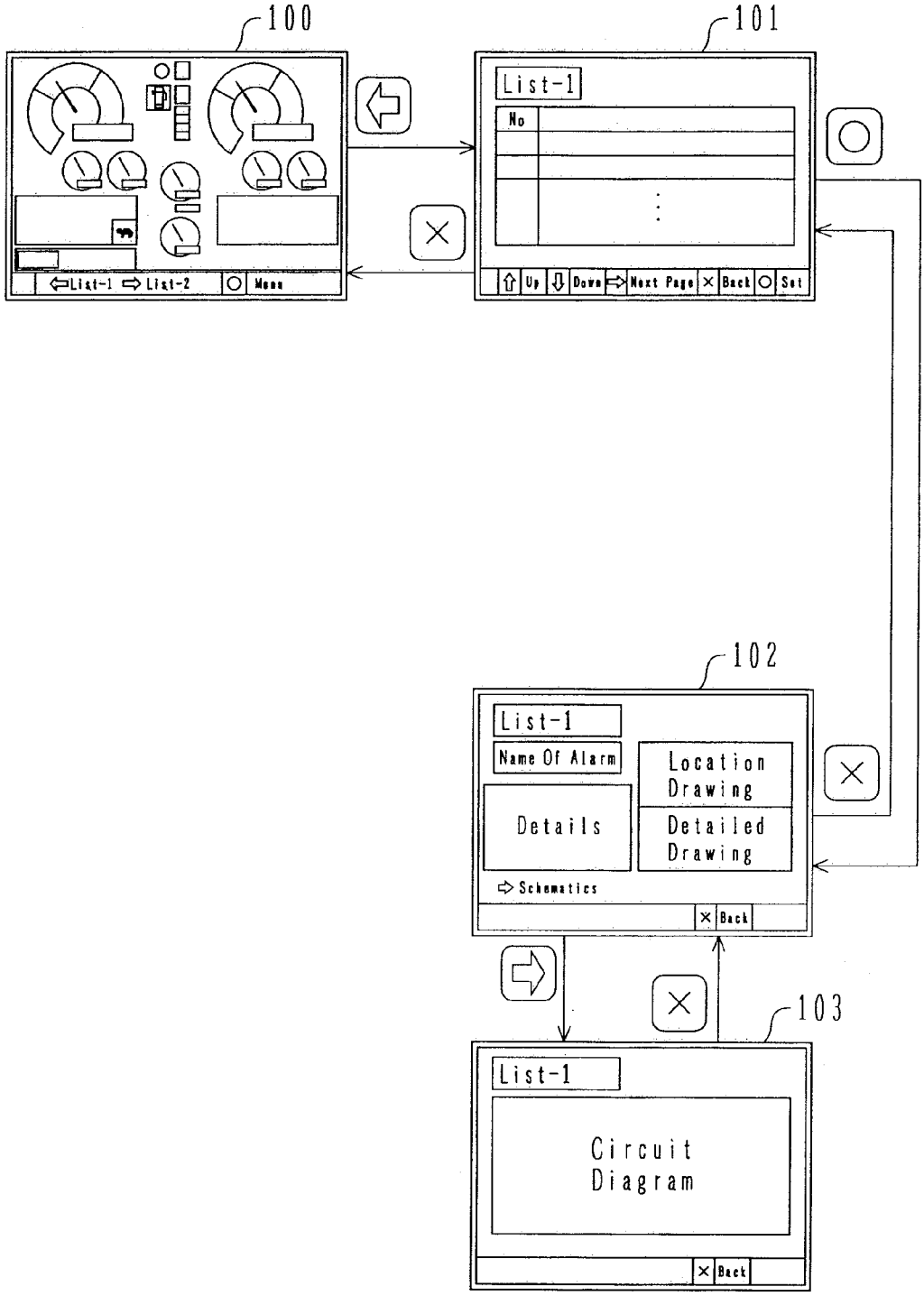
FIG. 10 is an explanatory view showing screens displayed in a changeable manner by the alarm display-side screen shift function of the screen display control section provided in the controller which constitutes one embodiment of the diagnostic information providing apparatus for the construction machine according to the present invention.
Figure 11:
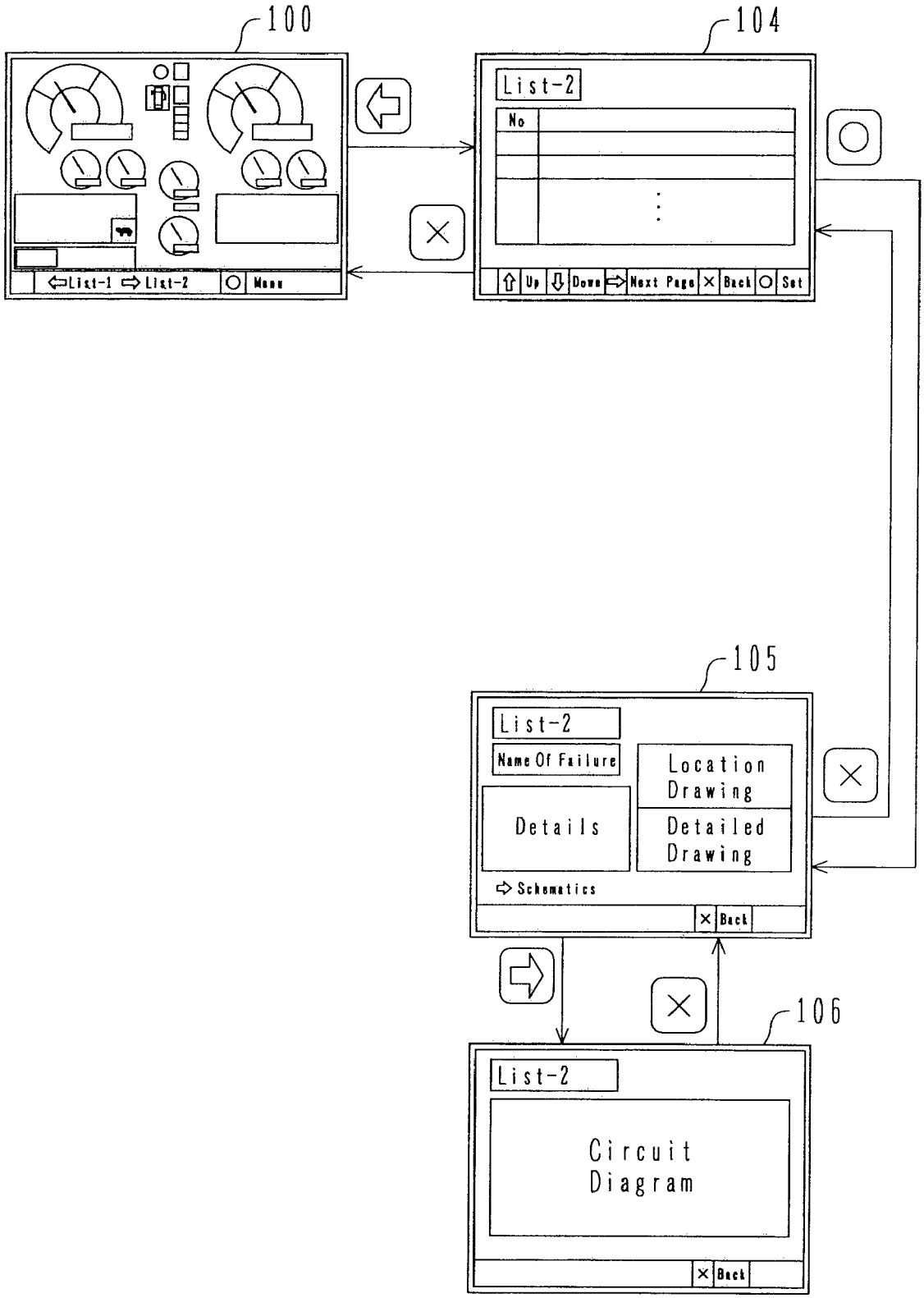
FIG. 11 is an explanatory view showing screens displayed in a changeable manner by the failure display-side screen shift function of the screen display control section provided in the controller which constitutes one embodiment of the diagnostic information providing apparatus for the construction machine according to the present invention.

FIG. 9 is a flowchart showing control procedures for an alarm display-side screen shift function and a failure display-side screen shift function of the screen display control section 2G provided in the controller 2 which constitutes one embodiment of the diagnostic information providing apparatus for the construction machine according to the present invention. FIG. 10 shows screens displayed in a changeable manner by the alarm display-side screen shift function of the screen display control section 2G, and FIG. 11 shows screens displayed in a changeable manner by the failure display-side screen shift function of the screen display control section 2G.

In FIG. 9, the initial screen 100 is first displayed on the display unit 50 in step 10. If the operator manipulates the "←" button 51*f* of the keypad 51 in the state of the initial screen 100 being displayed, the corresponding keypad operational signal X is inputted from the signal input processing section 2A to the screen display control section 2G (this process is similarly applied to subsequent steps). Also, since the determination of step 20 is satisfied, the control flow enters an alarm-side screen shift mode and proceeds to step 30 in which the screen image is changed to an alarm list (List-1) screen 101 indicating a list of the contents of alarms occurred at that time (see FIG. 10). By manipulating the "↑" button 51*d* or the "↓" button 51*e* of the keypad 51 in such a state, the cursor position on the screen 101 is moved up or down in the screen 101. If the operator now manipulates the "x" button 51*b* of the keypad 51, the determination of step 40 is satisfied and the control flow returns to step 10, whereupon the screen image is returned to the initial screen 100. On the other hand, if the operator manipulates the "○" button 51*a* of the keypad 51 in the state of one alarm being selected by a cursor, the determination of step 50 is satisfied via step 40 and the control flow proceeds to step 60.

In step 60, a detailed information screen 102 of the selected alarm is displayed (see FIG. 10). This screen 102 indicates the name of the alarm, details of the alarm, a location drawing representing a location where the alarm occurs (as one example, the location drawing may be cited from a corresponding portion of specification drawings, design drawings, etc. for the relevant construction machine), and a detailed drawing of the location (e.g., an enlarged drawing). By looking at those drawings, therefore, the operator can easily understand in detail what kind of alarm occurs in which location. If the operator now manipulates the "x" button 51*b* of the keypad 51, the determination of step 70 is satisfied and the control flow returns to step 30, whereupon the screen image is returned to the alarm list screen 101. On the other hand, if the operator manipulates the "→" button 51*g* of the keypad 51, the determination of step 80 is satisfied via step 70 and the control flow proceeds to step 90.

In step 90, a circuit diagram screen 103 indicating the location where the selected alarm occurs is displayed (see FIG. 10). In this screen 103, the alarm occurrence location indicated on the location drawing in the detailed information screen 102 is more specifically indicated on a circuit diagram (hydraulic or electric circuit) to show a precise position of the alarm occurrence location on the circuit diagram. Therefore, the operator can easily understand in which position the alarm occurs on the circuit diagram and how the alarm occurrence location is functionally related to other part locations. If the operator manipulates the "x" button 51*b* of the keypad 51, the determination of step 100 is satisfied and the control flow returns to step 60, whereupon the screen image is returned to the previous detailed information screen 102.

On the other hand, if the operator manipulates the "→" button 51*g* of the keypad 51 in the state of the initial screen 100 being displayed in step 10, the determination of step 110 is satisfied via step 20 and the control flow enters an failure-side screen shift mode and proceeds to step 120 in which the screen image is changed to a failure list (List-2) screen 104 indicating a list of the contents of failures occurred at that time (see FIG. 11). By manipulating the "↑" button 51*d* or the "↓" button 51*e* of the keypad 51 in such a state, the cursor position on the screen 104 is moved up or down in the screen 104. If the operator now manipulates the "x" button 51*b* of the keypad 51, the determination of step 130 is satisfied and the control flow returns to step 10, whereupon the screen image is returned to the initial screen 100. On the other hand, if the operator manipulates the "○" button 51*a* of the keypad 51 in the state of one failure being selected by a cursor, the determination of step 140 is satisfied via step 130 and the control flow proceeds to step 150.

In step 150, a detailed information screen 105 of the selected failure is displayed (see FIG. 11). This screen 105 indicates the name of the failure, details of the failure, a location drawing representing a location where the failure occurs (as one example, the location drawing may be cited from a corresponding portion of specification drawings, design drawings, etc. for the relevant construction machine), and a detailed drawing of the location (e.g., an enlarged drawing). By looking at those drawings, therefore, the operator can easily understand in detail what kind of failure occurs in which location. If the operator now manipulates the "x" button 51*b* of the keypad 51, the determination of step 160 is satisfied and the control flow returns to step 120, whereupon the screen image is returned to the failure list screen 104. On the other hand, if the operator manipulates the "→" button 51*g* of the keypad 51, the determination of step 170 is satisfied via step 160 and the control flow proceeds to step 180.

In step 180, a circuit diagram screen 106 indicating the location where the selected failure occurs is displayed (see FIG. 11). In this screen 106, the failure occurrence location indicated on the location drawing in the detailed information screen 105 is more specifically indicated on a circuit diagram (hydraulic or electric circuit) to show a precise position of the failure occurrence location on the circuit diagram. Therefore, the operator can easily understand in which position the failure occurs on the circuit diagram and how the failure occurrence location is functionally related to other part locations. If the operator now manipulates the "x" button 51*b* of the keypad 51, the determination of step 190 is satisfied and the control flow returns to step 150, whereupon the screen image is returned to the previous detailed information screen 105.

Returning to FIG. 8, the manual snapshot control section 2E is used to execute a manual snapshot function, for example, when the operator wants to know the cause of an unusual condition of the machine and to manually collect various data concentrated in a short period at his discretion. The manual snapshot control section 2E comprises an intermediate processing section 2Ea, a manual snapshot processing section 2Eb, a storage processing section 2Ec, and a playback processing section 2Ed.

The intermediate processing section 2Ea executes primary processing of the status variable data. More specifically, the intermediate processing section 2Ea takes in, via the signal input processing section 2A, all the detected signals transmitted from the sensor 40, etc. (or from each unit of the sensor groups or each sub-controller mentioned above) at predetermined intervals, classifies or assorts those data for, e.g., each sensor (or each status variable), and stores or loads the data on the time serial basis.

In accordance with a manual snapshot command signal (signal for indicating an item selected for the manual snapshot function, described in detail later) inputted from the keypad 51 via the signal input processing section 2A, the manual snapshot processing section 2Eb extracts and reads the status variable data corresponding to the command signal from the intermediate processing section 2Ea and produces, as manual snapshot data, the status variable data falling within a predetermined time corresponding to, e.g., a manual snapshot start signal inputted from the keypad 51 via the signal input processing section 2A. The manual snapshot processing section 2Eb previously stores a map of combinations between snapshot items and a plurality of status variables corresponding to each of the formers. FIG. 12 shows one example of the map.

As shown in FIG. 12, the combinations are set, by way of example, such that, for a snapshot item of "output drop of engine (1) (=engine on one side)", the data representing "engine revolution speed", "throttle position", "intake manifold temperature", "intercooler inlet temperature", "turbo boosted pressure", "engine derating on/off-state", and "operation on/off-state (whether any operation is performed)" are collected as corresponding status variables. The "operation on/off-state" can be obtained, for example, by taking the logical OR of the front operating signal, the swing operating signal, and the track operating signal in the controller 2.

Thus, in the manual snapshot processing section 2Eb, the above-described data extracting process is executed while referring to the map shown in FIG. 12.

Returning to FIG. 8, the storage processing section 2Ec stores or loads the manual snapshot data produced by the manual snapshot processing section 2Eb as described above, and also stores the same manual snapshot data as the loaded data in an external storage (e.g., a nonvolatile memory or a flash memory) 3 outside the controller 2 in accordance with an appropriate command signal from the operator side (e.g., a key switch-off signal).

In accordance with a playback command signal (signal indicating the manual snapshot data to be played back as a motion picture, described in detail later) inputted from the keypad 51 via the signal input processing section 2A, the playback processing section 2Ed extracts and reads the manual snapshot data corresponding to the command signal from the storage processing section 2Ec and plays back the manual snapshot data, as a motion picture (which may be a still picture instead), in accordance with the command signal (as described in detail later).

The automatic snapshot control section 2F is used to automatically collect various data concentrated in a short period regardless of the operator's intention when an alarm or failure indication is given by the alarm display control section 2C or the failure display control section 2D. The automatic snapshot control section 2F comprises an intermediate processing section 2Fa, an automatic snapshot processing section 2Fb, a storage processing section 2Fc, and a playback processing section 2Fd.

The intermediate processing section 2Fa executes primary processing of the status variable data. More specifically, the intermediate processing section 2Fa takes in, via the signal input processing section 2A, all the detected signals transmitted from the sensor 40, etc. (or from each unit of the sensor groups or each sub-controller mentioned above) at predetermined intervals, classifies or assorts those data for, e.g., each sensor (or each status variable), and stores or loads the data on the time serial basis.

The automatic snapshot processing section 2Fb includes storage means capable of continuously storing data (e.g., the so-called ring buffer which continuously stores data while updating data corresponding to a predetermined time in an overwrite manner). With such storage means, the automatic snapshot processing section 2Fb extracts and reads the status variable data, which has been classified or assorted by the intermediate processing section 2Fa as described above, from the intermediate processing section 2Fa, and it continuously produces automatic snapshot primary data while updating the data in an overwrite manner. The automatic snapshot processing section 2Fb previously stores a map of combinations between alarm/failure items and a plurality of status variables corresponding to each of the formers. FIG. 13 shows one example of the map.

As shown in FIG. 13, the combinations are set, by way of example, such that, when a "coolant overheat alarm" is issued, the data representing "atmospheric temperature", "coolant temperature in upper manifold", "air temperature at radiator front surface", "radiator outlet temperature", "inlet pressure of radiator cooler fan motor", "coolant pump delivery pressure/upper manifold pressure", and "engine revolution speed" are collected as corresponding status variables. The "coolant pump delivery pressure/upper manifold pressure" can be obtained, for example, by detecting the respective pressures and dividing the former pressure by the latter pressure in the controller 2.

Thus, in the automatic snapshot processing section 2Fb, the above-described process of producing the automatic snapshot primary data while updating the data in an overwrite manner is executed while referring to the map shown in FIG. 13. When the alarm or failure display signal is inputted from the alarm display control section 2C or the failure display control section 2D, the automatic snapshot primary data is extracted and read, out of the ring buffer or the like, from among the data stored in the ring buffer or the like, which falls within a predetermined time (e.g., 1 minute on the preceding side and 5 minutes on the succeeding side) with the input time of the alarm or failure display signal being as a reference, thereby producing the automatic snapshot data (final data).

Returning to FIG. 8, the storage processing section 2Fc stores or loads the automatic snapshot (final) data produced by the automatic snapshot processing section 2Fb as described above, and also stores the same automatic snapshot data as the loaded data in the external storage (e.g., the non-volatile memory or the flash memory) 3 outside the controller 2 in accordance with the appropriate command signal from the operator side (e.g., the key switch-off signal).

In accordance with a playback command signal (signal commanding selection of the alarm/failure to play back corresponding automatic snapshot data, described in detail later) inputted from the keypad 51 via the signal input processing section 2A, the playback processing section 2Fd extracts and reads the automatic snapshot data corresponding to the command signal from the storage processing section 2Fc and plays back the automatic snapshot data, as a motion picture (which may be a still picture instead), in accordance with the command signal (as described in detail later).

Figure 14:
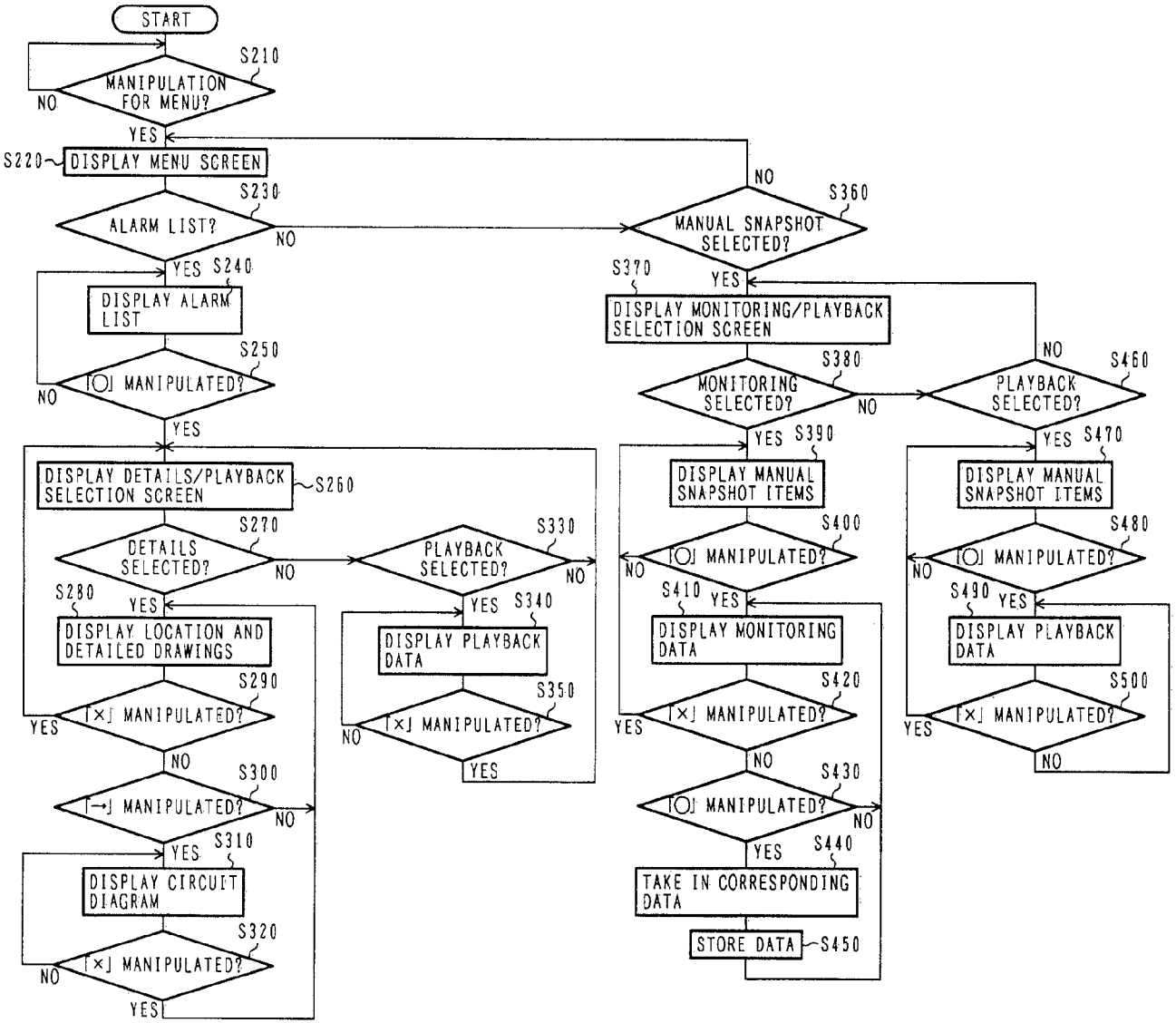
FIG. 14 is a flowchart showing control procedures for a manual snapshot processing function and an automatic snapshot processing function executed by the screen display control section, a manual snapshot control section, and an automatic snapshot control section all provided in the controller which constitutes one embodiment of the diagnostic information providing apparatus for the construction machine according to the present invention.
Figure 15:
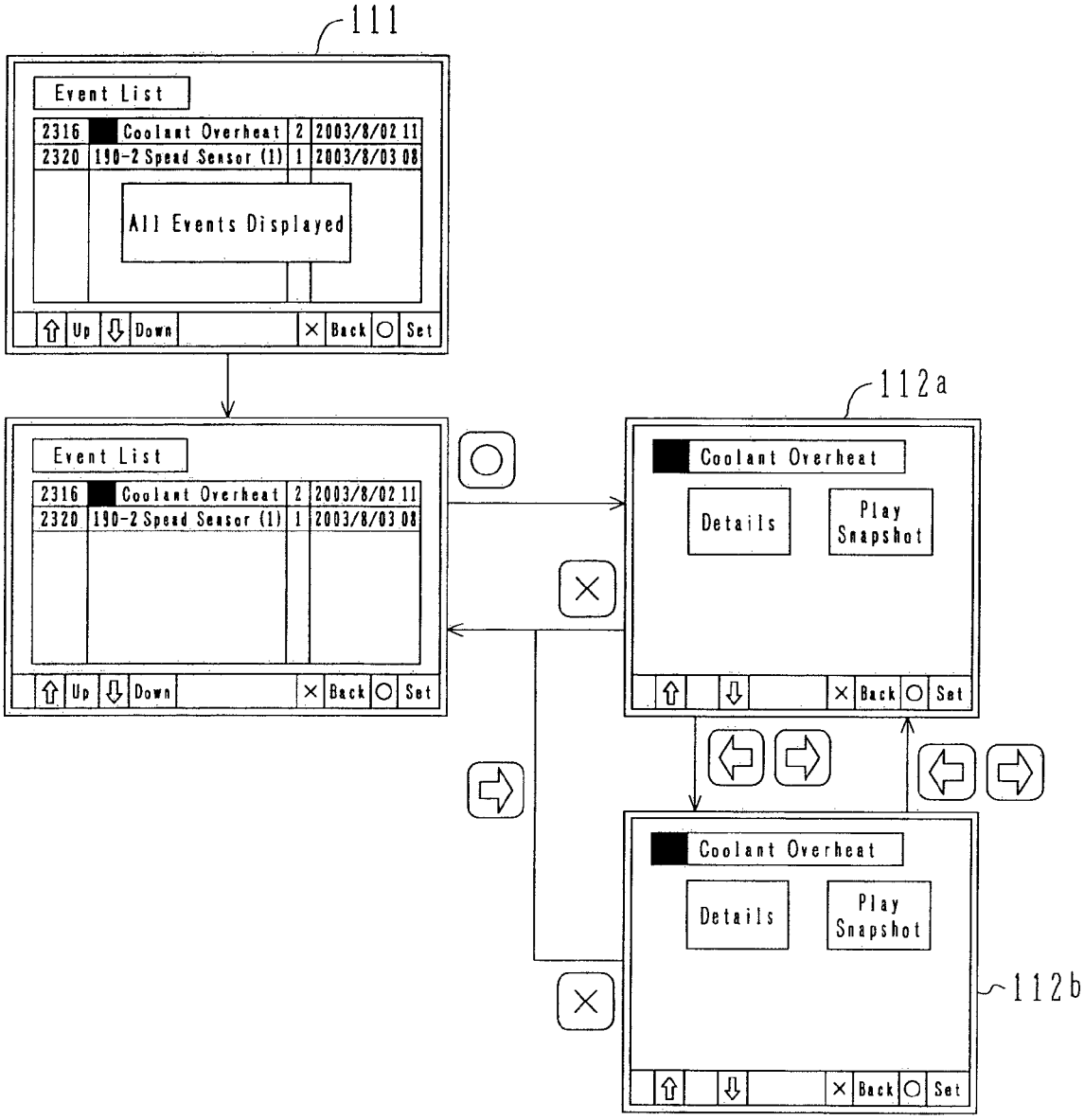
FIG. 15 shows screens displayed in a changeable manner during an automatic snapshot process by the screen display control section provided in the controller which constitutes one embodiment of the diagnostic information providing apparatus for the construction machine according to the present invention.
Figure 16:
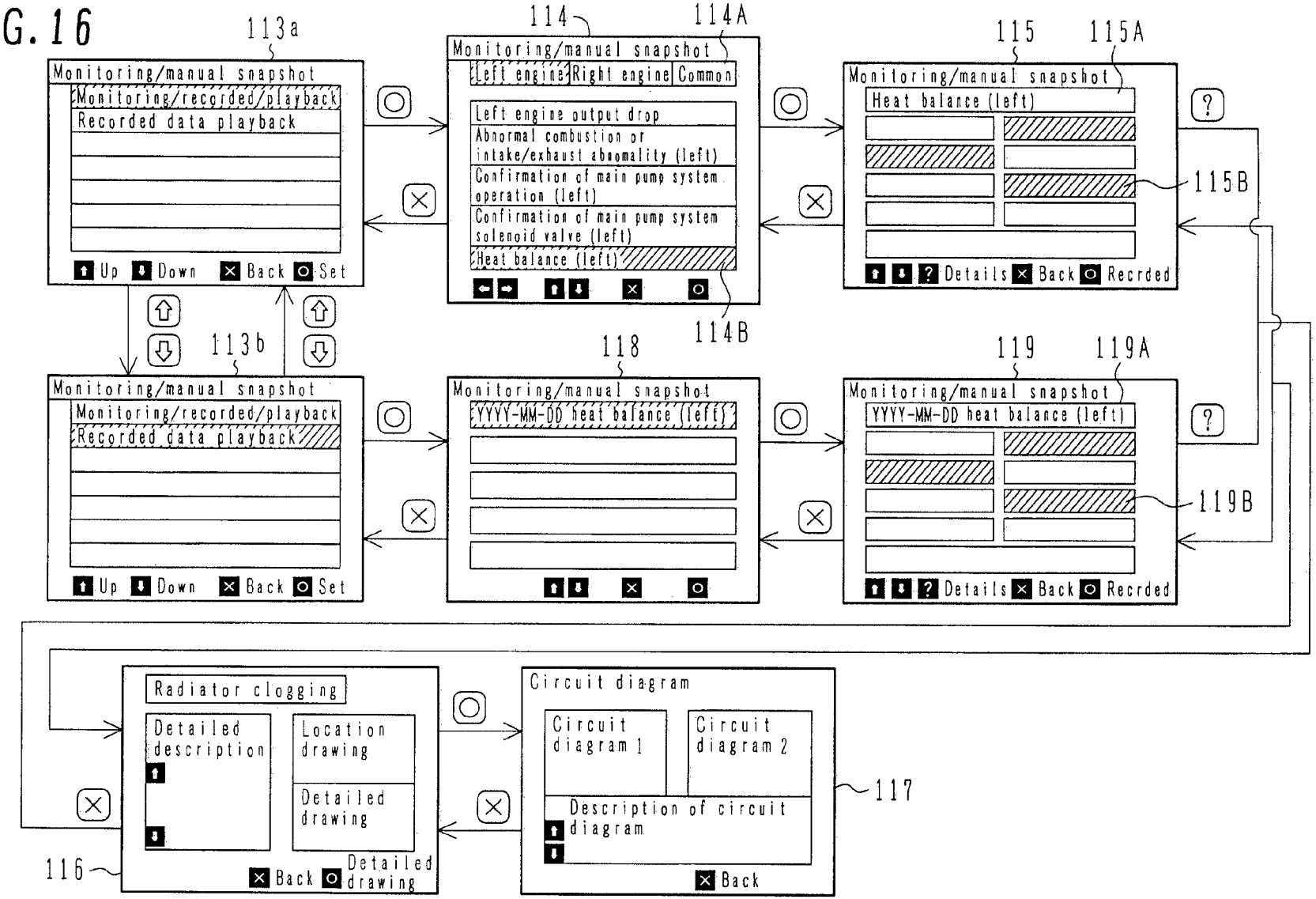
FIG. 16 shows screens displayed in a changeable manner during a manual snapshot process by the screen display control section provided in the controller which constitutes one embodiment of the diagnostic information providing apparatus for the construction machine according to the present invention.

FIG. 14 is a flowchart showing control procedures for a manual snapshot processing function and an automatic snapshot processing function executed by the screen display control section 2G, the manual snapshot control section 2E, and the automatic snapshot control section 2F all provided in the controller 2 which constitutes one embodiment of the diagnostic information providing apparatus for the construction machine according to the present invention. FIG. 15 shows screens displayed in a changeable manner during an automatic snapshot process by the screen display control section 2G, and FIG. 16 shows screens displayed in a changeable manner during a manual snapshot process by the screen display control section 2G.

In FIG. 14, if the operator manipulates the "○" button 51*a* of the keypad 51 in the state of the initial screen 100 being displayed on the display unit 50, the corresponding keypad operational signal X is inputted from the signal input processing section 2A to the screen display control section 2G (this process is similarly applied to subsequent steps). Also, since the determination of step 210 is satisfied, the control flow proceeds to step 220 in which a (service) menu screen 110 is displayed.

Figure 17:
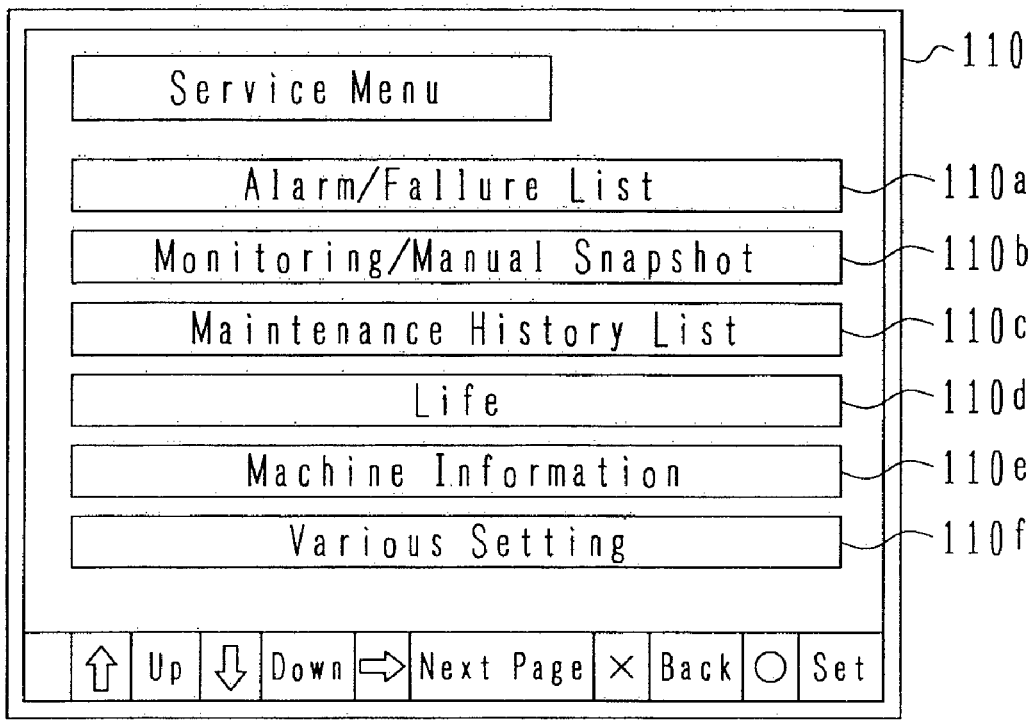
FIG. 17 shows a menu screen displayed on the display unit when the keypad is manipulated in the state of the initial screen being displayed.

FIG. 17 shows the menu screen 110. As shown in FIG. 17, the screen 110 has an "alarm/failure list" button 110*a* for displaying a list of current and past alarms and failures (the button 110*a* enabling the automatic snapshot data to be played back subsequently), and a "monitoring/manual snapshot" button 110*b* for executing the manual snapshot function.

Returning to FIG. 14, if the operator manipulates the "↑" or "↓" button 51*d*, 51*e* of the keypad 51 to select the "alarm/failure list" button 110*a* and manipulates the "○" button 51*a* of the keypad 51 in the state of the menu screen 110 being displayed in step 220, the determination of step 230 is satisfied and the control flow enters an automatic snapshot-side screen shift mode and proceeds to step 240 in which the screen display control section 2G changes the screen image to an alarm/failure (event) list screen 111 (see FIG. 15) indicating a list of the contents of alarms/failures occurred at that time and in the past based on the signals from the alarm display control section 2C and the failure display control section 2D. That screen 111 roughly indicates the name of the alarm or the failure, the occurrence date and time of the alarm or the failure, etc. Therefore, the operator can easily recognize what kinds of troubles occurred in the past for the machine operated by himself (or one or more preceding operators). When the operator manipulates the "↑" or "↓" button 51*d*, 51*e* of the keypad 51 in such a state, the cursor position on the screen 111 is moved up or down. If the operator manipulates the "○" button 51*a* of the keypad 51 in the state of one alarm or failure data being selected, the determination of step 250 is satisfied and the control flow proceeds to step 260.

In step 260, the screen display control section 2G changes the screen image to a details/playback selection screen 112 (i.e., a state where a later-described screen 112*a* or 112*b* is displayed) for prompting the operator to select a shift to a screen for indicating details of the selected alarm or failure or a shift to a playback screen for playing back the automatic snapshot data which has already been collected and stored at that time (see FIG. 15). By manipulating the "←" or "→" button 51*f*, 51*g* of the keypad 51, the cursor position on the screen 112 is moved for selection of a "details" button or a "snapshot playback" button. If the operator manipulates the "○" button 51*a* of the keypad 51 in the state of "details" being selected (i.e., in the screen 112*a* of FIG. 15), the determination of step 270 is satisfied and the control flow proceeds to step 280.

In step 280, a detailed information screen of the selected alarm or failure is displayed (though not shown). This detailed information screen is similar to the above-described screen 102 (see FIG. 10) or screen 105 (see FIG. 11) and indicates the name of the alarm/failure, details of the alarm/failure, a location drawing representing a location where the alarm/failure occurs, and a detailed drawing of the location (e.g., an enlarged drawing). If the operator now manipulates the "x" button 51*b* of the keypad 51, the determination of step 290 is satisfied and the control flow returns to step 260, whereupon the screen image is returned to the previous screen 112. On the other hand, if the operator manipulates the "→" button 51*g* of the keypad 51, the determination of step 300 is satisfied via step 290 and the control flow proceeds to step 310.

In step 310, a circuit diagram screen indicating the location where the selected alarm or failure occurs is displayed (though not shown). This circuit diagram screen is similar to the above-described screen 103 (see FIG. 10) or screen 106 (see FIG. 11) and more specifically indicates the alarm/failure occurrence location, which has been indicated on the location drawing in the detailed information screen, on a circuit diagram (hydraulic or electric circuit) to show a precise position of the alarm/failure occurrence location on the circuit diagram. If the operator now manipulates the "x" button 51*b* of the keypad 51, the determination of step 320 is satisfied and the control flow returns to step 280, whereupon the screen image is returned to the previous detailed information screen.

In the state where the details/playback selection screen 112 is displayed in step 260, if the operator manipulates the "○" button 51*a* of the keypad 51 while selecting the "snapshot playback" button (i.e., in the screen 112*b* of FIG. 15), the determination of step 330 is satisfied via step 270 and the control flow proceeds to step 340.

In step 340, the playback processing section 2Fd displays a motion picture playback screen to play back, in the form of a motion picture, the automatic snapshot data which has already been produced by the automatic snapshot processing section 2Fb and stored in the storage processing section 2Fc in relation to the selected alarm or failure. Though not shown in detail, this motion picture playback screen has an area for indicating the name of the automatic snapshot item (e.g., "coolant overheat alarm"), and an area for indicating changes of each status variable within a certain time. If the operator now manipulates the "x" button 51*b* of the keypad 51, the determination of step 350 is satisfied and the control flow returns to step 260, whereupon the screen image is returned to the previous screen 112.

On the other hand, if the operator manipulates the "↑" or "↓" button 51*d*, 51*e* of the keypad 51 to select the "monitoring/manual snapshot" button 110*b* and manipulates the "○" button 51*a* of the keypad 51 in the state of the menu screen 110 being displayed in step 220, the determination of step 360 is satisfied via step 230 and the control flow enters a manual snapshot-side screen shift mode and proceeds to step 370 in which the screen display control section 2G changes the screen image to a monitoring/playback selection screen 113 (i.e., a state where a later-described screen 113*a* or 113*b* is displayed) for prompting the operator to select a shift to a monitoring screen for displaying the current status variable data related to each snap shot item and for producing and recording the manual snapshot data or a shift to a playback screen for playing back the manual snapshot data which has already been collected and stored at that time (see FIG. 16). By manipulating the "↑" or "↓" button 51*d*, 51*e* of the keypad 51, the cursor position on the screen 113 is moved for selection of a "monitoring/recording/playback" button or a "recorded data playback" button. If the operator manipulates the "○" button 51*a* of the keypad 51 in the state of the "monitoring/recording/playback" button being selected (i.e., in the screen 113*a* of FIG. 16), the determination of step 380 is satisfied and the control flow proceeds to step 390.

In step 390, the screen display control section 2G changes the screen image to a manual snapshot item screen 114 (see FIG. 16). This manual snapshot item screen 114 has engine item buttons 114A for selecting the target engine 32 (e.g., "left engine", "right engine" and "common" buttons in FIG. 16), and buttons 114B representing the manual snapshot items described above with reference to FIG. 12 (e.g., buttons representing "engine output drop", "abnormal combustion or intake/exhaust abnormality", "confirmation of main pump system operation", "confirmation of main pump system solenoid valve", "heat balance", etc. regarding the left engine in FIG. 16). When the operator manipulates the "←" or "→" button 51*f*, 51*g* of the keypad 51, the cursor position is moved to the left or right over the engine item buttons 114A, and when the operator manipulates the "↑" or "↓" button 51*d*, 51*e* of the keypad 51, the cursor position is moved up or down over the snapshot item buttons 114B. If the operator manipulates the "○" button 51*a* of the keypad 51 after selecting each one of the engine item buttons 114A and the snapshot item buttons 114B (e.g., the "left engine" button and the "heat balance" button in FIG. 16), the determination of step 400 is satisfied and the control flow proceeds to step 410.

In step 410, the status variable data corresponding to the selected engine item 114A and snapshot item 114B are taken in. More specifically, as described above, the manual snapshot processing section 2Eb extracts and reads, from the intermediate processing section 2Ea, the status variable data corresponding to the selected items (e.g., the data representing "atmospheric temperature", "air temperature at radiator front surface", "radiator outlet temperature", "coolant temperature in upper manifold", "inlet pressure of hydraulic motor for cooler fan", and "coolant pressure (coolant pump delivery pressure/upper manifold pressure)" when the heat balance is selected), and then outputs the read status variable data to the screen display control section 2G. The screen display control section 2G changes the screen image to a monitoring screen 115 on which changes of the current status variable data are indicated (see FIG. 16). The monitoring screen 115 has an area 115A for indicating the snapshot item ("heat balance" in FIG. 16), and a plurality of status variable indication areas 115B for indicating changes of the individual status variables.

Figure 18:
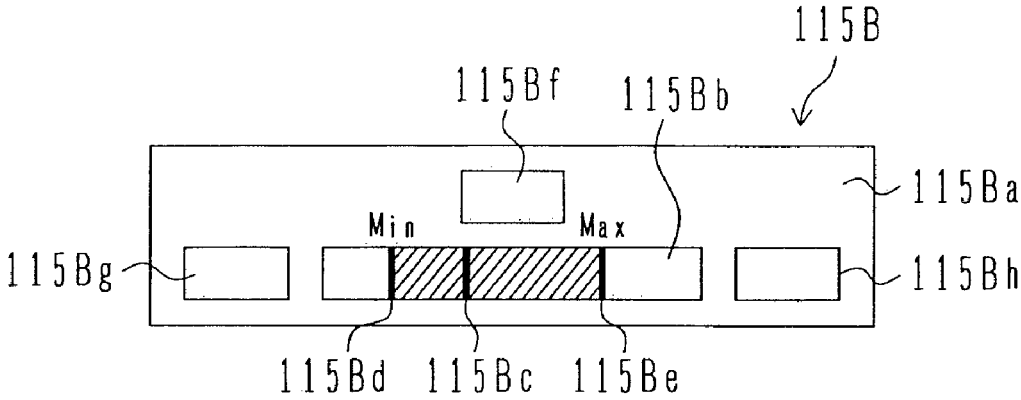
FIG. 18 shows, by way of example, details of a status variable display area in FIG. 16.

FIG. 18 shows, by way of example, details of a status variable display area 115B of the monitoring screen 115. As shown in FIG. 18, in the status variable display area 115B, reference numeral 115Ba represents a background area, 115Bb denotes a bar display area having opposite ends which correspond to detectable (or displayable) minimum and maximum values of the status variable, and 115Bc denotes an indicator bar which is movable to the left or right in the bar display area 115Bb for indicating changes of the status variable. Numerals 115Bd, 115Be denote respectively a minimum indicator bar and a maximum indicator bar indicating a minimum value and a maximum value of the status variable in a predetermined time (e.g., a period from a time of changing to the monitoring screen 115 to a time of changing to another screen). By looking at those areas, the operator can easily recognize the changes of each status variable and the amplitude thereof. In addition, a part of the bar display area 115Bb between the minimum indicator bar 115Bd and the maximum indicator bar 115Be may be displayed in different color for easier visual recognition. Further, there are provided a numerical value display area 115Bf corresponding to the indicator bar 115Bc, and numerical value display areas 115Bg, 115Bh corresponding to the minimum indicator bar 115Bd and the maximum indicator bar 115Be, respectively.

Herein, the most important feature of this embodiment resides in that the manual snapshot processing section 2Eb compares each of the status variables or a value computed through predetermined arithmetic processing based on a plurality of status variables, which are extracted and read from the intermediate processing section 2Ea (namely, the status variables displayed on the monitoring screen 115) in relation to the selected snapshot item, with a corresponding predetermined reference value range (i.e., a reference value range set and stored in advance), thereby determining whether a part corresponding to each status variable or the computed value is failed. If any failure is determined, the manual snapshot processing section 2Eb outputs a display signal for displaying the failed part (i.e., a failed part display signal) to the screen display control section 2G, whereupon the screen display control section 2G displays a corresponding screen. Such a part failure determination/display process will be described below, by way of example, in connection with the case of selecting "heat balance" as the snapshot item.

Figure 19:
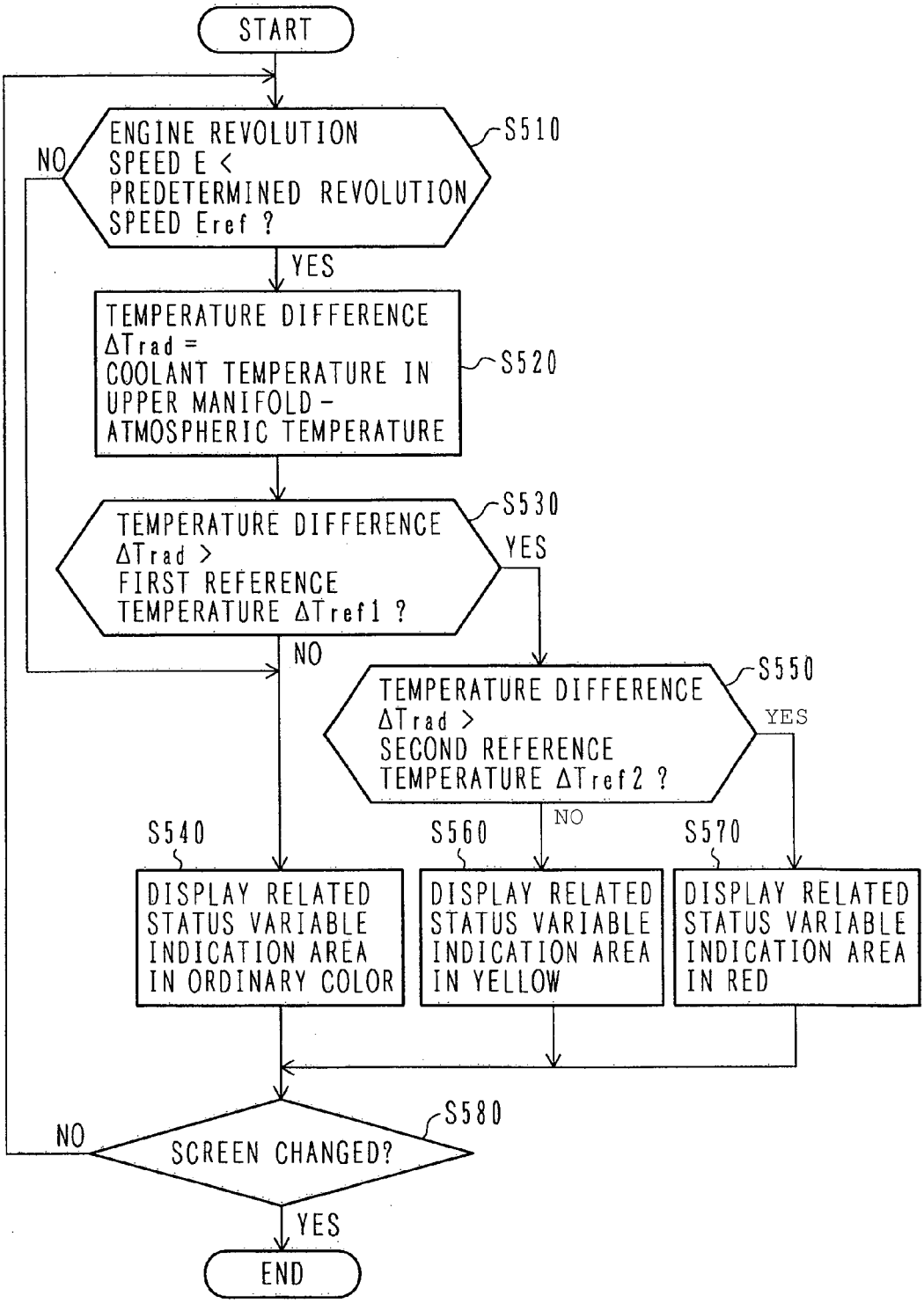
FIG. 19 is a flowchart showing control procedures of a failure determination/display process for a radiator executed in the manual snapshot control section and the screen display control section provided in the controller which constitutes one embodiment of the diagnostic information providing apparatus for the construction machine according to the present invention.
Figure 20:
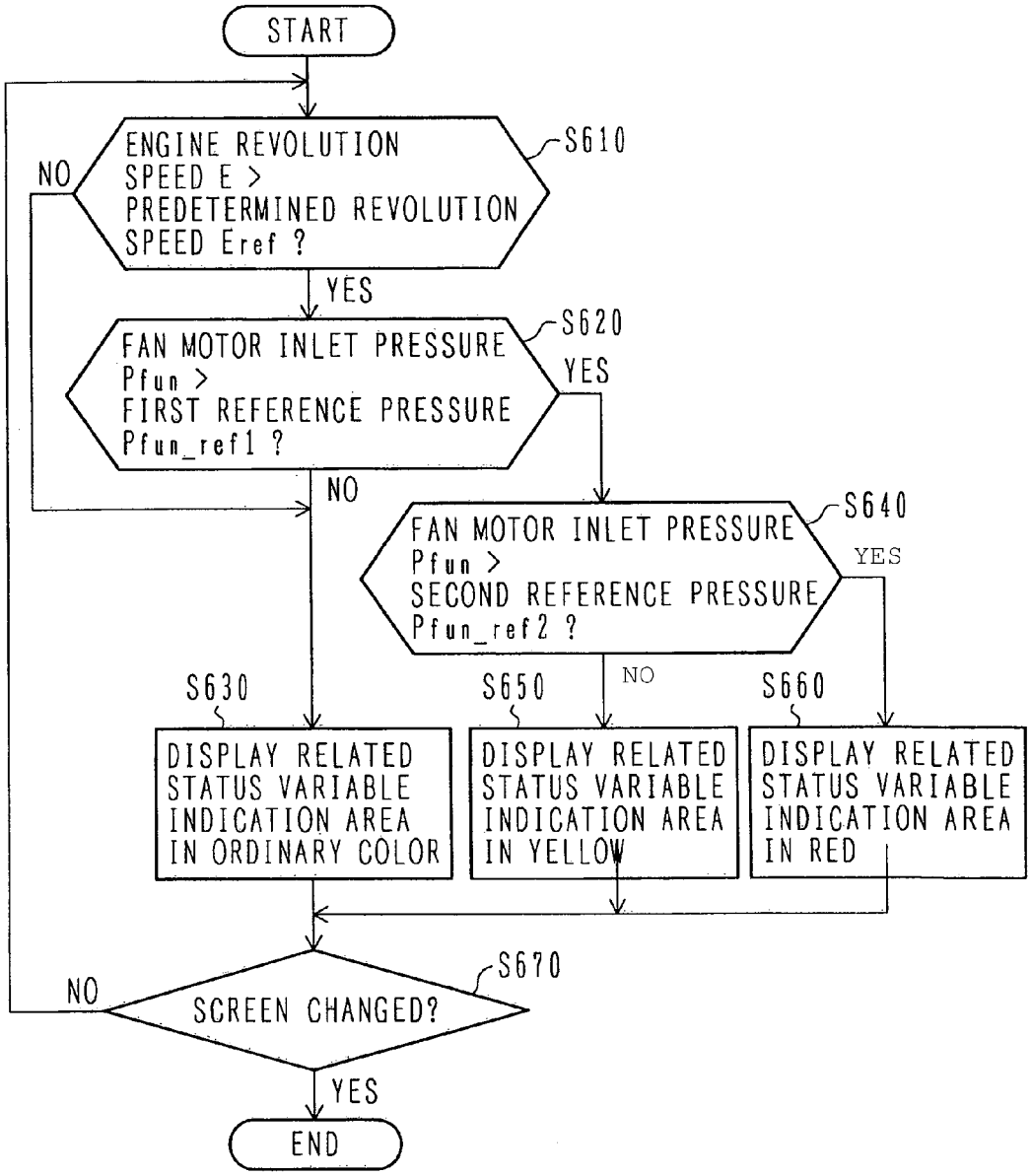
FIG. 20 is a flowchart showing control procedures of a failure determination/display process for a hydraulic motor for a cooling fan executed in the manual snapshot control section and the screen display control section provided in the controller which constitutes one embodiment of the diagnostic information providing apparatus for the construction machine according to the present invention.
Figure 21:
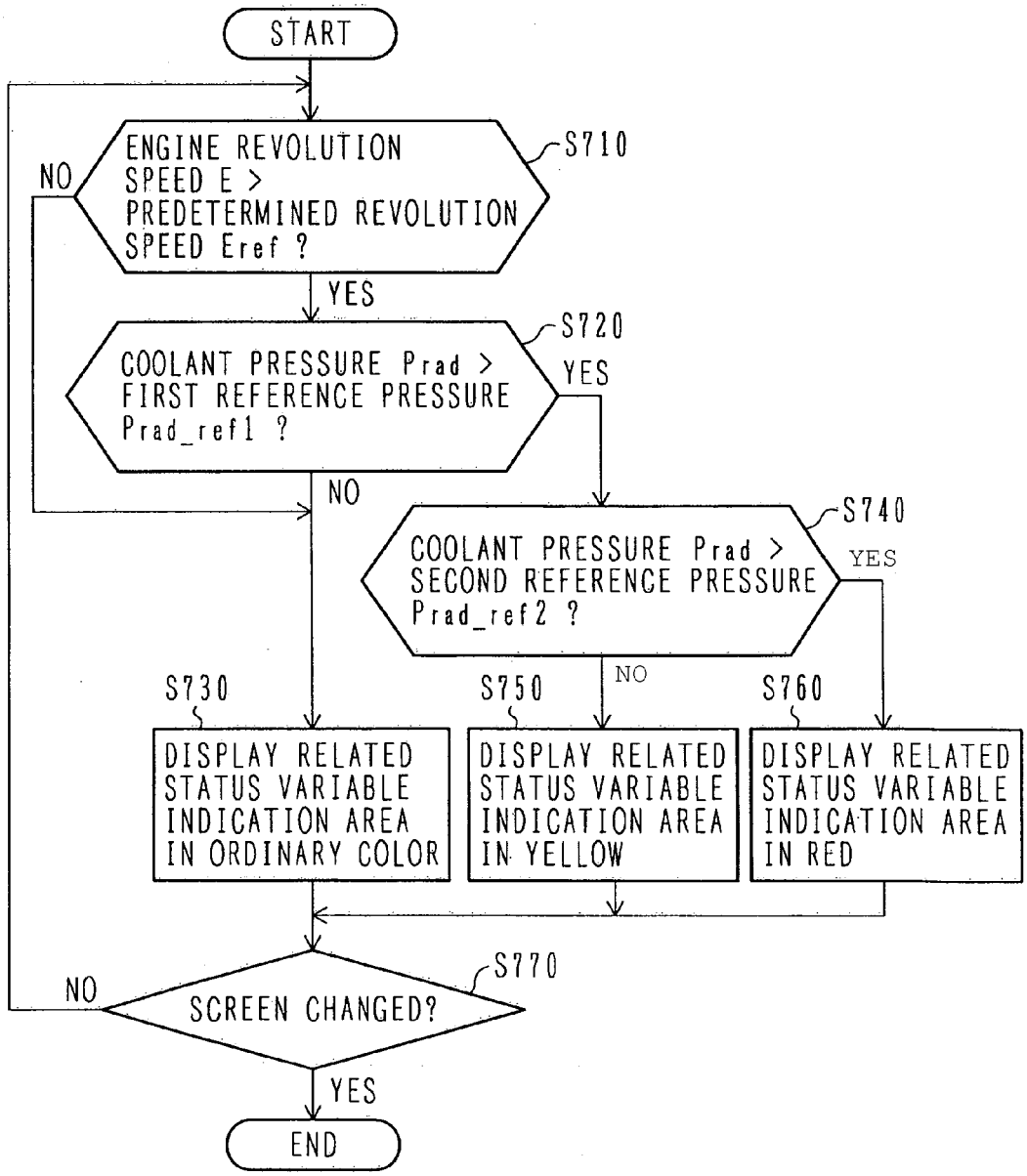
FIG. 21 is a flowchart showing control procedures of a failure determination/display process for a coolant pump and a piping system executed in the manual snapshot control section and the screen display control section provided in the controller which constitutes one embodiment of the diagnostic information providing apparatus for the construction machine according to the present invention.

FIG. 19 is a flowchart showing control procedures of a failure determination/display process for a radiator, FIG. 20 is a flowchart showing control procedures of a failure determination/display process for a hydraulic motor for a cooling fan, and FIG. 21 is a flowchart showing control procedures of a failure determination/display process for a coolant pump and a piping system.

(1) Failure Determination/Display Process for Radiator

Referring to FIG. 19, first, the manual snapshot processing section 2Eb determines in step 510 whether an engine revolution speed E, i.e., one of the status variable data taken in as described above, is higher than a predetermined revolution speed Eref which has been set and stored in advance. If the engine revolution speed E is higher than the predetermined revolution speed Eref, the determination of step 510 is satisfied and the control flow proceeds to step 520. In step 520, a temperature difference ΔTrad between the coolant temperature in the upper manifold and the atmospheric temperature, which are contained in the taken-in status variable data, is calculated. Then, the control flow proceeds to step 530 in which a predetermined first reference value ΔTref1 is read out from an internal memory, for example, and whether the calculated temperature difference ΔTrad is larger than the first reference value ΔTref1 is determined.

If the calculated temperature difference ΔTrad is not larger than the first reference value ΔTref1, this is regarded as meaning that a failure (such as clogging) does not occur in the radiator. Hence the determination of step 530 is not satisfied and the control flow proceeds to step 540. In step 540, the manual snapshot processing section 2Eb outputs an ordinary display signal representing no failure in the radiator (or the status variables "atmospheric temperature" and "coolant temperature in manifold" related to the radiator), and the screen display control section 2G displays the background area 115Ba of the status variable display area 115B for each of "atmospheric temperature" and "coolant temperature in manifold" in ordinary color (e.g., light blue).

If the temperature difference ΔTrad is larger than the first reference value ΔTref1 in step 530, the determination of step 530 is satisfied and the control flow proceeds to step 550. In step 550, a predetermined second reference value ΔTref2 (ΔTref2>ΔTref1) is read out from the internal memory, for example, and whether the calculated temperature difference ΔTrad is larger than the second reference value ΔTref2 is determined. If the calculated temperature difference ΔTrad is not larger than the predetermined second reference value ΔTref2 (i.e., ΔTref2≧ΔTref1>ΔTref1), this is regarded as meaning that a failure occurs to some extent in the radiator. Hence the determination of step 550 is not satisfied and the control flow proceeds to step 560. In step 560, the manual snapshot processing section 2Eb outputs a first-stage failure display signal representing some extent of a failure in the radiator (or the status variables "atmospheric temperature" and "coolant temperature in manifold" related to the radiator), and the screen display control section 2G displays the background area 115Ba of the status variable display area 115B for each of "atmospheric temperature" and "coolant temperature in manifold" in different color, e.g., yellow (display color for a failure of first stage).

On the other hand, if the temperature difference ΔTrad is larger than the predetermined second reference value ΔTref2, this is regarded as meaning that a failure occurs in the radiator. Hence the determination of step 550 is satisfied and the control flow proceeds to step 570. In step 570, the manual snapshot processing section 2Eb outputs a second-stage failure display signal representing a failure in the radiator (or the status variables "atmospheric temperature" and "coolant temperature in manifold" related to the radiator), and the screen display control section 2G displays the background area 115Ba of the status variable display area 115B for each of "atmospheric temperature" and "coolant temperature in manifold" in different color, e.g., red (display color for a failure of second stage).

If each of steps 540, 560 and 570 is completed, the control flow proceeds to step 580 in which it is determined whether the monitoring screen 115 is changed to another screen. If changed, the determination of step 580 is satisfied and the failure determination/display process for the radiator is brought to an end. On the other hand, if the monitoring screen 115 is not changed to another screen, the determination of step 580 is not satisfied and the control flow returns to step 510, followed by repeating the same procedures as those described above.

(2) Failure Determination/Display Process for Hydraulic Motor for Cooling Fan

Referring to FIG. 20, first, the manual snapshot processing section 2Eb determines in step 610 whether the engine revolution speed E, i.e., one of the taken-in status variable data, is higher than the predetermined revolution speed Eref which has been set and stored in advance. If the engine revolution speed E is higher than the predetermined revolution speed Eref, the determination of step 610 is satisfied and the control flow proceeds to step 620. In step 620, a predetermined first reference value Pfun_ref1 is read out from the internal memory, for example, regarding an inlet pressure Pfun of the hydraulic motor for the cooling fan which is another one of the taken-in status variable data, and whether the inlet pressure Pfun of the hydraulic motor for the cooling fan is higher than the predetermined first reference value Pfun_ref1 is determined.

If the inlet pressure Pfun of the hydraulic motor for the cooling fan is not higher than the predetermined first reference value Pfun_ref1, this is regarded as meaning that no failure occurs in the hydraulic motor for the cooling fan. Hence the determination of step 620 is not satisfied and the control flow proceeds to step 630. In step 630, the manual snapshot processing section 2Eb outputs an ordinary display signal representing no failure in the hydraulic motor for the cooling fan (or the status variable "inlet pressure of hydraulic motor for cooling fan" related to the hydraulic motor for the cooling fan), and the screen display control section 2G displays the background area 115Ba of the status variable display area 115B for "inlet pressure of hydraulic motor for cooling fan" in ordinary color (e.g., light blue).

If the inlet pressure Pfun of the hydraulic motor for the cooling fan is higher than the predetermined first reference value Pfun_ref1 in step 620, the determination of step 620 is satisfied and the control flow proceeds to step 640. In step 640, a predetermined second reference value Pfun_ref2 (Pfun_ref2>Pfun_ref1) is read out from the internal memory, for example, and whether the inlet pressure Pfun of the hydraulic motor for the cooling fan is higher than the predetermined second reference value Pfun_ref2 is determined. If the inlet pressure Pfun of the hydraulic motor for the cooling fan is not higher than the predetermined second reference value Pfun_ref2 (i.e., Pfun_ref2≧Pfun>Pfun_ref1), this is regarded as meaning that a failure occurs to some extent in the hydraulic motor for the cooling fan. Hence the determination of step 640 is not satisfied and the control flow proceeds to step 650. In step 650, the manual snapshot processing section 2Eb outputs a first-stage failure display signal representing some extent of a failure in the hydraulic motor for the cooling fan (or the status variable "inlet pressure of hydraulic motor for cooling fan" related to the hydraulic motor for the cooling fan), and the screen display control section 2G displays the background area 115Ba of the status variable display area 115B for "inlet pressure of hydraulic motor for cooling fan" in different color, e.g., yellow (display color for a failure of first stage).

On the other hand, if the inlet pressure Pfun of the hydraulic motor for the cooling fan is higher than the predetermined second reference value Pfun_ref2, this is regarded as meaning that a failure occurs in the hydraulic motor for the cooling fan. Hence the determination of step 640 is satisfied and the control flow proceeds to step 660. In step 660, the manual snapshot processing section 2Eb outputs a second-stage failure display signal representing a failure in the hydraulic motor for the cooling fan (or the status variable "inlet pressure of hydraulic motor for cooling fan" related to the hydraulic motor for the cooling fan), and the screen display control section 2G displays the background area 115Ba of the status variable display area 115B for "inlet pressure of hydraulic motor for cooling fan" in different color, e.g., red (display color for a failure of second stage).

If each of steps 630, 650 and 660 is completed, the control flow proceeds to step 670 in which it is determined whether the monitoring screen 115 is changed to another screen. If changed, the determination of step 670 is satisfied and the failure determination/display process for the hydraulic motor for the cooling fan is brought to an end. On the other hand, if the monitoring screen 115 is not changed to another screen, the determination of step 670 is not satisfied and the control flow returns to step 610, followed by repeating the same procedures as those described above.

(3) Failure Determination/Display Process for Coolant Pump and Piping System

Referring to FIG. 21, first, the manual snapshot processing section 2Eb determines in step 710 whether the engine revolution speed E, i.e., one of the taken-in status variable data, is higher than the predetermined revolution speed Eref which has been set and stored in advance. If the engine revolution speed E is higher than the predetermined revolution speed Eref, the determination of step 710 is satisfied and the control flow proceeds to step 720. In step 720, a predetermined first reference value Prad_ref1 is read out from the internal memory, for example, regarding a coolant pressure Prad which is another one of the taken-in status variable data, and whether the coolant pressure Prad is higher than the predetermined first reference value Prad_ref1 is determined.

If the coolant pressure Prad is not higher than the predetermined first reference value Prad_ref1, this is regarded as meaning that no failure occurs in the coolant pump. Hence the determination of step 720 is not satisfied and the control flow proceeds to step 730. In step 730, the manual snapshot processing section 2Eb outputs an ordinary display signal representing no failure in the coolant pump and the piping system (or the status variable "coolant pressure" related to the coolant pump and the piping system), and the screen display control section 2G displays the background area 115Ba of the status variable display area 115B for "coolant pressure" in ordinary color (e.g., light blue).

If the coolant pressure Prad is higher than the predetermined first reference value Prad_ref1 in step 720, the determination of step 720 is satisfied and the control flow proceeds to step 740. In step 740, a predetermined second reference value Prad_ref2 (Prad_ref2>Prad_ref1) is read out from the internal memory, for example, and whether the coolant pressure Prad is higher than the predetermined second reference value Prad_ref2 is determined. If the coolant pressure Prad is not higher than the predetermined second reference value Pfun_ref2 (i.e., Prad_ref2≧Prad>Prad_ref1), this is regarded as meaning that a failure occurs to some extent in the coolant pump and the piping system. Hence the determination of step 740 is not satisfied and the control flow proceeds to step 750. In step 750, the manual snapshot processing section 2Eb outputs a first-stage failure display signal representing some extent of a failure in the coolant pump and the piping system (or the status variable "coolant pressure" related to the coolant pump and the piping system), and the screen display control section 2G displays the background area 115Ba of the status variable display area 115B for "coolant pressure" in different color, e.g., yellow (display color for a failure of first stage).

On the other hand, if the coolant pressure Prad is higher than the predetermined second reference value Prad_ref2, this is regarded as meaning that a failure occurs in the coolant pump and the piping system. Hence the determination of step 740 is satisfied and the control flow proceeds to step 760. In step 760, the manual snapshot processing section 2Eb outputs a second-stage failure display signal representing a failure in the coolant pump and the piping system (or the status variable "coolant pressure" related to the coolant pump and the piping system), and the screen display control section 2G displays the background area 115Ba of the status variable display area 115B for "coolant pressure" in different color, e.g., red (display color for a failure of second stage).

If each of steps 730, 750 and 760 is completed, the control flow proceeds to step 770 in which it is determined whether the monitoring screen 115 is changed to another screen. If changed, the determination of step 770 is satisfied and the failure determination/display process for the coolant pump and the piping system is brought to an end. On the other hand, if the monitoring screen 115 is not changed to another screen, the determination of step 770 is not satisfied and the control flow returns to step 710, followed by repeating the same procedures as those described above.

As described above, the monitoring screen 115 displays not only changes of the status variable data related to the snapshot item selected by the operator, but also the presence or absence of a failure in each status variable and the corresponding part in a stepwise manner using different colors for display of the background area 115Ba of the status variable display area 115B.

Returning to FIG. 16, in the monitoring screen 115, when the operator manipulates the "↑", "↓", "←" or "→" button 51*d*, 51*e*, 51*f* or 51*g* of the keypad 51, the cursor position is moved upward, downward, leftward or rightward in the status variable display area 115B. Further, when the operator manipulates the "?" button 51*h* of the keypad 51 while selecting the status variable display area 115B in which the color of the background area 115Ba is changed to yellow or red, a detailed information screen 116 for the corresponding failure is displayed (see FIG. 16). This screen 116 indicates the name of the failure ("radiator clogging" in FIG. 16), details of the failure, a location drawing representing a location where the failure occurs (as one example, the location drawing may be cited from a corresponding portion of specification drawings, design drawings, etc. for the relevant construction machine), and a detailed drawing of the location (e.g., an enlarged drawing). By looking at those drawings, therefore, the operator can easily understand in detail what kind of failure occurs in which location.

If the operator manipulates the "x" button 51*b* of the keypad 51 in such a state, the screen image is returned to the previous screen 115. On the other hand, if the operator manipulates the "○" button 51*a* of the keypad 51, a circuit diagram screen 117 indicating the location where the failure occurs is displayed (see FIG. 16). In this screen 117, the failure occurrence location indicated on the location drawing in the detailed information screen 116 is more specifically indicated on a circuit diagram (hydraulic or electric circuit) to show a precise position of the failure occurrence location on the circuit diagram. Therefore, the operator can easily understand in which position the failure occurs on the circuit diagram and how the failure occurrence location is functionally related to other part locations. If the operator now manipulates the "x" button 51*b* of the keypad 51, the screen image is returned to the previous screen 116.

Returning to FIG. 14, if the operator manipulates the "x" button 51*b* of the keypad 51 in the state of the monitoring screen 115 being displayed in step 410, the determination of step 420 is satisfied and the control flow returns to step 390, whereupon the screen image is returned to the previous screen 114. On the other hand, if the operator manipulates the "○" button 51*a* of the keypad 51, the determination of step 430 is satisfied via step 420 and the control flow proceeds to step 440.

In step 440, the manual snapshot start signal is inputted to the manual snapshot processing section 2Eb from the signal input processing section 2A, whereupon the manual snapshot processing section 2Eb extracts and reads, from the intermediate processing section 2Ea, the status variable data corresponding to the above select manipulation, which falls within a predetermined time (e.g., preset ranges before and after the time of issuance of the manual snapshot command, the preset ranges may be settable in accordance with a command from the operator), thereby producing the manual snapshot data. Thereafter, the control flow proceeds to step 450 in which the storage processing section 2Ec records or loads the manual snapshot data produced by the manual snapshot processing section 2Eb. During steps 440 and 450, the screen display control section 2G displays the appropriate corresponding screen. After the completion of step 450, the control flow returns to step 410 in which the screen 115 is displayed.

In the state where the monitoring/playback selection screen 113 is displayed in step 370, if the operator manipulates the "○" button 51*a* of the keypad 51 while selecting the "monitoring/recording/playback" button (see the screen 113*b* of FIG. 16), the determination of step 460 is satisfied via step 380 and the control flow proceeds to step 470.

In step 470, the screen display control section 2G changes the screen image to a manual snapshot data list screen 118 (see FIG. 16). This screen 118 roughly indicates the name (e.g., heat balance in FIG. 16) of the stored or loaded manual snapshot data and the date and time when that data was stored or loaded. Therefore, the operator can easily recognize that attention was focused on what part or point in the past for the machine operated by himself (or one or more preceding operators). When the operator manipulates the "↑" or "↓" button 51*d*, 51*e* of the keypad 51 in such a state, the cursor position on the screen 118 is moved up or down. If the operator manipulates the "○" button 51*a* of the keypad 51 in the state of one kind of the manual snapshot data being thus selected, the determination of step 480 is satisfied and the control flow proceeds to step 490.

In step 490, the playback processing section 2Ed displays a motion picture playback screen 119 to play back, in the form of a motion picture, the selected manual snapshot data (see FIG. 16). This screen 119 has an area 119A for indicating the name and the date and time of the manual snapshot data, and a status variable display area 119B for indicating past changes of each status variable within a certain time. If the operator manipulates the "x" button 51*b* of the keypad 51 in the state of the motion picture playback screen 119 being displayed, the determination of step 500 is satisfied and the control flow returns to step 470, whereupon the screen image is returned to the previous screen 118.

The status variable display area 119B of the motion picture playback screen 119 has the same layout as that of the above-described status variable display area 115B shown in FIG. 18. The manual snapshot processing section 2Eb compares each of the status variables or a value computed through predetermined arithmetic processing based on a plurality of status variables, which are contained in the manual snapshot data (namely, the status variables displayed on the motion picture playback screen 119), with a corresponding predetermined reference value range (i.e., a reference value range set and stored in advance), thereby determining whether a part corresponding to each status variable or the computed value is failed. If any failure is determined, the manual snapshot processing section 2Eb outputs a display signal for displaying the failed part (i.e., a failed part display signal) to the screen display control section 2G, whereupon the screen display control section 2G displays a corresponding screen. Thus, the motion picture playback screen 119 displays not only changes of the status variable data contained in the manual snapshot data selected by the operator, but also the presence or absence of a failure in each status variable and the corresponding part in a stepwise manner using different colors (light blue, yellow and red in the above-described example) for display of the background area 115Ba of the status variable display area 115B.

Further, as shown in FIG. 16, in the state where the motion picture playback screen 119 is displayed, when the operator manipulates the "?" button 51*h* of the keypad 51 while selecting the status variable display area 119B in which the color of the background area 115Ba is changed to yellow or red, a detailed information screen 116 for the corresponding failure is displayed. If the operator manipulates the "x" button 51*b* of the keypad 51 in such a state, the screen image is returned to the previous screen 115. On the other hand, if the operator manipulates the "○" button 51*a* of the keypad 51, the circuit diagram screen 117 indicating the location where the failure occurs is displayed. If the operator further manipulates the "x" button 51*b* of the keypad 51, the screen image is returned to the previous screen 116.

Returning to FIG. 17, the menu screen 110 includes other buttons 110*c*, 110*d*, 110*e* and 110*f* in addition to the above-described buttons 110*a*, 110*b*.

Although a detailed description is omitted here, when the "maintenance history list" button 110*c* is manipulated, the screen display control section 2G performs a screen shift to a maintenance history list display screen (not shown). More specifically, whenever maintenance work, such as greasing to various parts, oil change, filter change, grease refilling, element change, coolant change, and working oil change, has been so far performed for the relevant machine, maintenance history data has been inputted by the worker or the operator and separately stored as maintenance history data in the storage means. The maintenance history list display screen is used to read and display the stored maintenance history. For example, the maintenance history list display screen indicates the maintenance items, the time interval (for change) preset for each item, and the time lapsed from the last actual change to the current time together.

Although a detailed description is omitted here, when the "life" button 110*d* is manipulated, the screen display control section 2G displays a life data display screen for indicating the accumulative operation time of each part from the start of operation of the machine, which has been collected by an operation time collecting function (not shown) of the controller 2 for each part.

Although a detailed description is omitted here, when the "machine information" button 110*e* is manipulated, the screen display control section 2G displays a machine information (property) data display screen for indicating specific information of the machine itself, such as the machine model number, the machine body number, the name of the controller, the name of software, and the version.

Although a detailed description is omitted here, when the "various settings" button 110*f* is manipulated, the screen display control section 2G displays a various-settings screen for setting the maintenance period, the on/off condition of each alarm, and others.

With this embodiment constructed as described above, for example, when the operator manipulates the keypad 51 so as to display the snapshot item screen 114 (see FIG. 16 described above) and selects one manual snapshot item, e.g., "heat balance", the status variable data related to the selected item is acquired by the manual snapshot control section 2E and is displayed on the monitoring screen 115 by the screen display control section 2G. On that occasion, the manual snapshot control section 2E computes each of the status variables (e.g., the inlet pressure Pfun of the hydraulic motor for the cooling fan or the coolant pressure Prad) or a value (e.g., the temperature difference ΔTrad between the coolant temperature in the upper manifold and the atmospheric temperature) computed based on a plurality of status variables, which are contained in the acquired status variable data (namely, the status variables displayed on the motion picture playback screen 119), with corresponding one of a plurality of predetermined reference values. If the status variable or the computed value is outside a predetermined reference value range, it is determined in a stepwise manner that a corresponding part is failed (more specifically, that a failure occurs to such an extent as not generating an abnormality as a detection result). Further, if a failure is determined, the background area 115Ba of the status variable display area 115B related to the failed part is displayed in a stepwise manner using different colors, e.g., yellow and red. When the operator selects the status variable display area 115B, the detailed information screen 116 for the corresponding failure and the circuit diagram drawing 117 for the failed part are displayed.

Moreover, for example, in the case of the operator intuitively perceiving a sign indicating an abnormality, e.g., a drop of engine output, during the operation, when the operator manipulates the keypad 51 to display the monitoring screen 115 and enters a recording command, the status variable data related to the snapshot item and falling within the predetermined time (i.e., the manual snapshot data) is produced and store by the manual snapshot control section 2E. Thereafter, when the operator manipulates the keypad 51 to display the manual snapshot data list screen 118 and selects the manual snapshot data, the selected manual snapshot data is read by the manual snapshot control section 2E and is played back to be displayed on the motion picture playback screen 119 by the screen display control section 2G. On that occasion, the manual snapshot control section 2E compares each of the status variables or a value computed based on a plurality of status variables, which are contained in the read status variable data (namely, the status variables displayed on the motion picture playback screen 119), with each of a plurality of corresponding predetermined reference values. If the status variable or the computed value is outside a predetermined reference value range, a failure of a corresponding part is determined in a stepwise manner. Further, if a failure is determined, the background area of the status variable display area 119B related to the failed part is displayed in a stepwise manner using different colors, e.g., yellow and red. When the operator selects the status variable display area 119B, the detailed information screen 116 for the corresponding failure and the circuit diagram drawing 117 for the failed part are displayed.

Thus, according to this embodiment, the status variable data related to the snapshot item or the stored manual snapshot data is displayed on the display unit 50, and whether a part corresponding to each status variable is failed is determined. If a failure is determined, the failed part or the related status variable is displayed on the display unit 50. Therefore, the operator can find an abnormality before it actually occurs. Also, any serviceman can easily specify the failed part regardless of experiences and skills of individual servicemen. As a result, it is possible to cut the operation suspended time of the hydraulic excavator 1, and to increase productivity.

Further, this embodiment can provide the following advantages.

(1) Advantage of Reducing Burden on Operation with Simplification in Display of Initial Screen According to this embodiment, the sensor 40, etc. detect the status variables related to the operating state or the ambient environment, and in response to the detected signals, the basic data display control section 2B of the controller 2 outputs the basic data display signals required for the initial screen 100 to the display unit 50, thereby displaying those signals in the basic data display area 50A. On the other hand, in accordance with alarm information related to the status variables detected by the sensor 40, etc., the alarm display control section 2C outputs the alarm display signals to the display unit 50, thereby displaying alarms in the alarm display areas 50Ba and 50Bb. Further, in accordance with failure information from the sensor 40, etc., the failure display control section 2D outputs the failure display signal to the display unit 50, thereby displaying a failure in the failure display area 50Bc.

Thus, on the initial screen 100 of the display unit 50, unless the operator specifically instructs a screen shift during the machine operation, only the least necessary basic data is displayed in the basic data display area 50A without displaying other data, while the alarm/failure is displayed in the alarm/failure display area 50B. As a result, abnormal information of the construction machine can be effectively presented with the least necessary data by displaying the data in such a manner as avoiding the operator from feeling psychological burden and discomfort over an allowable level.

(2) Advantage with Automatic Snapshot Function

According to this embodiment, when the alarm or the failure is displayed in the alarm/failure display area 50B of the initial screen 100, a portion of the status variable data related to the alarm or the failure, which falls within the predetermined time, is automatically acquired and stored by the automatic snapshot control section 2F of the controller 2. When the operator manipulates the keypad 51 later in the state of the alarm/failure list screen 111 being displayed, the playback processing section 2Fd outputs the playback display signal and displays the motion picture playback screen.

Thus, from the alarm/failure display presented in the least necessary way on the initial screen 100, the operator is able to confirm details of the alarm/failure, as required, for assistance to failure diagnosis. In particular, in the ordinary mode, the alarm/failure-related status variables falling within the predetermined time are automatically acquired with no need of particular manipulation by the operator, and can be played back later for display. Therefore, the location and details of an abnormality in the construction machine can be precisely presented without including useless extra information. As a result, it is possible to minimize the suspension time when an abnormality occurs in the construction machine, and to increase productivity.

(3) Advantage with Maintenance History Display

A construction machine, such as a large-sized hydraulic excavator, used for excavation of earth and stones in a very wide worksite or the like is continuously operated, and only an operator takes turns in operation of the machine per predetermined time. In the event of any alarm or failure, for example, the succeeding operator often wants to know what maintenance has been performed during the work by the preceding operator. To be adapted for such a situation, in this embodiment, when the operator manipulates the "maintenance history list" button 110*c* of the menu screen 110 upon looking at the displayed alarm or failure, a list of maintenance history data is displayed on the maintenance history list display screen.

Thus, from the alarm/failure display presented in the least necessary way on the initial screen 100, the operator is able to confirm maintenance situations, as required, for assistance to failure diagnosis.

While the above embodiment has been described as using, as one example of display means, the display unit 50 disposed inside the cab 14 of the hydraulic excavator 1, the present invention is not limited to such an example. Alternatively, the display means may be a PC terminal capable of receiving data downloaded via communication means, e.g., wires, radio or the Internet.

Further, while the above description has been made in connection with the hydraulic excavator 1 as an example of the construction machine, an application field of the present invention is not limited to the hydraulic excavator. The present invention is also applicable to other types of construction machines, such as a crawler crane and a wheel loader, and can provide similar advantages in those applications.

The invention claimed is:

1. A diagnostic information display system for a construction machine, the system installed in the construction machine and comprising:

display means disposed inside a cab of the construction machine;

detection means for detecting status variables related to an operating state of the construction machine or ambient environment;

storage means for storing combinations between a plurality of snapshot items, as items about a failure that occurs to such an extent that it does not generate an abnormality as a detection result, and status variables related to each of the snapshot items in advance;

operating means disposed inside the cab of the construction machine, and being capable of inputting a command by an operator for selecting one of the snapshot items and for displaying changes of current status variables related to the selected snapshot item;

manual snapshot processing means for acquiring the status variables, which is regarded as being related based on the stored combinations, from corresponding detected signals of said detection means with respect to the snapshot item selected by said operating means;

failure determining means for comparing each of the status variables or a value computed based on a plurality of status variables, which are acquired by said manual snapshot processing means, with a corresponding predetermined reference value range, and determining the failure when the status variable or the computed value is outside the predetermined reference value range; and status variable display control means for displaying the status variables, which are acquired by said manual snapshot processing means, with distinguishing the status value, which said failure determining means has determined the failure based on, on said display means.

2. The diagnostic information display system for a construction machine according to claim 1, wherein said failure determining means compares the status variable or the computed value with each of a plurality of corresponding reference value ranges to determine the failure in a stepwise manner, and said status variable display control means displays the status variable, which said failure determining means has determined the failure based on, to distinguish the status variable in accordance with a stage of the failure.

3. The diagnostic information display system for a construction machine according to claim 1, wherein said status variable display control means displays changes of the status variable and a minimum value and a maximum value of the status variable within the predetermined time.

4. The diagnostic information display system for a construction machine according to claim 1, wherein said status variable display control means changes a color of a background area of status variable display area to distinguish the status variable, which said failure determining means has determined the failure based on.

5. A diagnostic information display system for a construction machine, the system installed in the construction machine and comprising:

display means disposed inside a cab of the construction machine;

detection means for detecting status variables related to an operating state of the construction machine or ambient environment;

storage means for storing combinations between a plurality of snapshot items, as items about a failure that occurs to such an extent that it does not generate an abnormality as a detection result, and status variables related to each of the snapshot items in advance;

first operating means disposed inside the cab of the construction machine, and being capable of inputting a command by an operator for selecting one of the snapshot items and for producing a manual snapshot data containing changes of status variables, which are related to the selected snapshot item, within a predetermined time;

manual snapshot processing means for acquiring status variable data, which is regarded as being related based on the stored combinations and falls within the predetermined time, from corresponding detected signals of said detection means with respect to the snapshot item selected by said first operating means, thereby producing and recording the manual snapshot data in said storage means;

second operating means disposed inside the cab of the construction machine, and being capable of inputting a command by an operator for displaying the manual snapshot data stored in said storage means;

failure determining means for comparing each of the status variables or a value computed based on a plurality of status variables, which are contained in the manual snapshot data indicated by said second operating means, with a corresponding predetermined reference value range, and determining the failure when the status variable or the computed value is outside the predetermined reference value range; and status variable display control means for playing back and displaying changes of the status variables within the predetermined time, which are contained in the manual snapshot data indicated by said second operating means, with distinguishing the status value, which said failure determining means has determined the failure based on, on said display means.

6. The diagnostic information display system for a construction machine according to claim 5, wherein said failure determining means compares the status variable or the computed value with each of a plurality of corresponding reference value ranges to determine the failure in a stepwise manner, and said status variable display control means displays the status variable, which said failure determining means has determined the failure based on, to distinguish in accordance with a stage of the failure.

7. The diagnostic information display system for a construction machine according to claim 5, wherein said status variable display control means displays changes of the status variable and a minimum value and a maximum value of the status variable within the predetermined time.

8. The diagnostic information display system for a construction machine according to claim 5, wherein said status variable display control means changes a color of a background area of status variable display area to distinguish the status variable, which said failure determining means has determined the failure based on.

* * * * *

UNITED STATES PATENT AND TRADEMARK OFFICE

CERTIFICATE OF CORRECTION

PATENT NO. : 7,684,917 B2
APPLICATION NO. : 11/571482
DATED : March 23, 2010
INVENTOR(S) : Furuno et al.

It is certified that error appears in the above-identified patent and that said Letters Patent is hereby corrected as shown below:

ON THE TITLE PAGE

Please insert (30) Foreign Application Priority Data:

--(30) Foreign Application Priority Data
Nov. 17, 2004 (JP) ..... 2004-333101--

Signed and Sealed this

Eleventh Day of May, 2010

David J. Kappos

David J. Kappos
*Director of the United States Patent and Trademark Office*